US006888511B2

(12) United States Patent
Cake

(10) Patent No.: US 6,888,511 B2
(45) Date of Patent: May 3, 2005

(54) PHYSICALLY SMALL ANTENNA ELEMENTS AND ANTENNAS BASED THEREON

(76) Inventor: Brian Victor Cake, 248 Barrataria Dr., St. Augustine, FL (US) 32080

( * ) Notice: Subject to any disclaimer, the term of this patent is extended or adjusted under 35 U.S.C. 154(b) by 0 days.

(21) Appl. No.: 10/649,137

(22) Filed: Aug. 26, 2003

(65) Prior Publication Data

US 2004/0070548 A1 Apr. 15, 2004

Related U.S. Application Data

(60) Provisional application No. 60/473,766, filed on May 29, 2003, and provisional application No. 60/409,015, filed on Sep. 9, 2002.

(51) Int. Cl.[7] ..... H01Q 19/10
(52) U.S. Cl. ..... 343/803
(58) Field of Search ..... 343/803, 793, 343/797, 749, 817, 818, 752

(56) References Cited

U.S. PATENT DOCUMENTS 6,356,242 B1 * 3/2002 Ploussios ..... 343/795
6,580,398 B2 6/2003 Breakall ..... 343/751
6,650,301 B1 * 11/2003 Zimmerman ..... 343/803
6,664,930 B2 * 12/2003 Wen et al. ..... 343/702
6,717,551 B1 * 4/2004 Desclos et al. ..... 343/700 MS
6,781,556 B2 * 8/2004 Kojima et al. ..... 343/818

* cited by examiner

*Primary Examiner*—Wilson Lee
*Assistant Examiner*—Huedung X. Cao
(74) *Attorney, Agent, or Firm*—Frommer Lawrence & Haug LLP; William S. Frommer; Darren M. Simon

(57) ABSTRACT

A shaped antenna element that radically reduces the physical size needed for resonance without the use of lossy loading elements, while at the same time allowing direct connection to a coaxial feeder. The element is composed of at least two sub-elements in close proximity to each other, coupled electrically to each other such that the radiation resistance of the composite element is increased substantially. The composite element can be used either as an antenna or part of an antenna that consists of multiple such elements in order to provide increased directivity.

18 Claims, 29 Drawing Sheets

PHYSICALLY SMALL ANTENNA ELEMENTS AND ANTENNAS BASED THEREON

CROSS-REFERENCE TO RELATED APPLICATIONS

This application claims the benefit of U.S. Provisional Application 60/409,015 filed Sep. 9, 2002 and U.S. Provisional Application 60/473,766 filed May 29, 2003, the entire contents thereof being incorporated herein by reference.

FIELD OF THE INVENTION

The present invention relates generally to physically small antenna elements and the use of such elements in dual-band high directivity arrays.

BACKGROUND OF THE INVENTION

The basic building block for a large class of antennas is the half-wave dipole. This consists of a length of wire or tubing, generally fed at the center, which resonates at a frequency corresponding to a wavelength of twice the length of the dipole. For many applications, the physical length of a half-wave dipole is too great to be accommodated in the available space, and a great deal of research effort has been expended in finding ways of reducing antenna size without compromising performance. There are many techniques currently in use to reduce the size of an antenna element. The basic problems with short elements are:

A short element has capacitive reactance that must be 'tuned out' in order for the element to accept power. The inductance required can be produced by a conventional solenoid inductor or by using a short-circuited transmission line, or by other means, but all of these methods reduce antenna efficiency because of ohm losses in the inductor, however made.

The bandwidth of a reduced size antenna is substantially reduced from that of a full size half-wave dipole. This means that it can be impossible to cover a desired frequency range without re-tuning the antenna The radiation resistance of the reduced size antenna is substantially lowered. This low resistance must be matched to the antenna feed line in order to avoid high standing wave ratio, with associated power loss, in the feed cable. Matching circuits can be used but they also have associated power loss. Techniques for feeding the antenna off-center are commonly used to raise the input resistance, but have problems associated with a feedpoint that is not located at a voltage node. Alternative matching solutions include the "gamma match" and the "T match" and other similar systems, but they all have in common difficulty in combining several short elements in order to obtain operation over many different frequency bands.

Other small antennas that are commonly in use include the magnetic loop antenna, characterized by very low radiation resistance, low bandwidth and a need to be remotely tunable in order to provide multi-band coverage.

The present antenna element disclosed herein has reasonable bandwidth, a low loss impedance transformation capability built in to its structure to allow direct connection to a feed cable, and the ability to be connected to other reduced size elements in order to provide multi-band operation without using switching or matching circuits. It may also be used in high directivity yagi-like antennas.

There is a plethora of information in the prior art relating to the design and use of physically small antennas. Some basic limits to the bandwidth and Q factor associated with small antennas are developed in Richard C. Johnson, "Antenna Engineering Handbook." (Third Edition, McGraw-Hill, Inc., New York) Small antennas and their limitations are discussed in John D. Kraus, "Antennas," (Second Edition, McGraw-Hill, Inc, New York, 1988) and in John A. Kuecken, "Antennas and Transmission Lines," (First Edition, Howard W. Sams & Co. Inc, New York, 1969). Design problems and solutions for short antennas principally for use in hand-held radio communication devices are discussed in K. Fujimoto et al., "Small Antennas," (John Wiley and Sons, Inc., New York 1987). U.S. Pat. No. 3,083,364 (to Scheldorf) discloses a helical monopole antenna of reduced physical size, designed to be used in conjunction with a ground plane, that incorporates a structure similar to that of a folded dipole that increases the feedpoint impedance such that, for example, a coaxial cable having a characteristic impedance of 50 ohms can be directly connected thereto.

Prior art solutions to resonating a physically small dipole antenna so that it will accept power from a transmission line all use inductive loading techniques, and may use capacitive end loading techniques in order to increase radiation resistance and lower the amount of loading inductance needed. FIG. 1 shows a short dipole (also known as a "Hertzian" dipole), consisting of an element much shorter than a half-wavelength (2), and a source (1). As an example, if the length of the dipole shown in FIG. 1 is 0.15λ and the dipole is fabricated from wire of diameter 0.001λ, the radiation resistance is only approximately 4.4 ohms and the series reactance is −j930 ohms.

In order to feed power to the above antenna, the feedpoint resistance has to be transformed up to 50 ohms, and the capacitive reactance must be tuned out with a series inductance, or circuit equivalent thereto, having a reactance of +j930 ohms. Such an antenna system is illustrated in FIG. 2. A loading inductor 3 is inserted in series with the element 2 and the source 1. Prior art also uses capacitive end-loading of the dipole in order to reduce the capacitive reactance. Such end-loading may consist of discs or skeleton discs connected to each end of the dipole, such discs being of diameter substantially larger than that of the wire. FIG. 3 shows such an antenna. The end capacitive loading is provided by wires 4 and 5, and the inductor 3 in series with the element 2 and the source 1 may be smaller and less lossy than that needed when no end loading is used. Other loads used in the prior art consist of a length of wire running at right angles to the dipole wire axis and parallel to a ground-plane, as in an inverted L antenna illustrated in FIG. 4, where the source 1 drives the element 2 over a ground-plane 6. When such end-loads are used, not only is the capacitive reactance reduced, but also the radiation resistance is increased. The maximum value of radiation resistance that can be achieved by end-loading a short dipole is four times that of the unloaded dipole. For an inverted L antenna, as in FIG. 4, and the total wire length is approximately 0.25λ, then the antenna is resonant and the reactance of the short dipole is completely cancelled out. Thus the feed point impedance is purely resistive and all that is needed in order to feed the antenna with power in a 50 ohm system is a transformer, or to tap the source along the antenna at a point that shows a 50 ohm load resistance.

Although there are many different wire configurations found in the prior art, they are all basically similar in that they attempt to raise the radiation resistance and cancel, or minimize, the series capacitive reactance.

The prior art in directive antennas, such as yagis, is well covered in R. Dean Straw et. al., "The ARRL Antenna Handbook," (19th Edition, American Radio Relay League, Newington, 2000). Single band yagis normally consist of an array of elements that are approximately 0.5λ long spaced from each along a boom, as shown in FIG. 5. A source, 1, drives the driven element, 2. The reflector, 7, and the directors, 8, 9, and 10 (more or less directors may be used than illustrated) are coupled by the electromagnetic field in such a way that the antenna becomes directional, with the direction of the beam being along the boom away from the reflector. The directivity or gain of such an antenna having many directors, know as a long yagi, is given approximately by:

Gain $G \approx 10 \log_{10} 10L_\lambda$, where $L_\lambda$ is the boom length in wavelengths.

Multiband operation is commonly achieved by placing parallel resonant circuits know as "traps" in pairs in series with each of the elements: these traps effectively isolate the outer sections of the elements and allow resonance and antenna operation at a second, higher frequency. However the traps are lossy and cause power and gain loss, and also reduce the operating bandwidth. They are rarely used in long yagis that operate in the vhf bands and above because of the number of traps needed, thus almost all high performance long yagis for vhf and upwards are single band devices.

SUMMARY OF THE INVENTION

Therefore, the present invention discloses physically small antenna elements that permit fabrication of reduced-size antennas without the use of loading reactances and without the penalty of reduced input resistance associated with conventional reduced-size elements. The elements may be used in a wide variety of antennas that conventionally would use full size half-wave dipole elements. A virtually loss-less impedance transformer is integrated into each element such that antennas using the elements can be connected directly to a coaxial feeder. Several such elements may be connected in parallel in order to produce a multi-band physically small antenna that does not require band-switching or impedance matching circuits. The elements may be arranged in similar fashion to a yagi-type antenna in order to provide enhanced directivity in a reduced-size antenna. In one embodiment, directional antennas are disclosed that have unique advantages over conventional yagi-type antennas. The directional antenna allows operation on two frequencies, without the use of diplexing or matching networks. The antenna gain on the upper of the two frequencies is higher than that of a conventional yagi-type antenna having the same boom length, and on the lower of the two frequencies the gain is similar to that of a conventional yagi-type antenna having the same boom length. The polarization of the radiated field may be the same at each of the two frequencies, or it may be cross-polarized. Alternatively, a directional antenna is disclosed that provides much higher directivity for a given antenna boom length than a conventional yagi-type antenna.

In a preferred embodiment of invention, the antenna element comprises first and second sub-elements. The first sub-element has a total length of approximately one-half wavelength in a substantially rectangular shape. The first sub-element comprises first and third sides, each having a length of approximately one-sixth wavelength; and second and fourth sides, each having a width of approximately one-twelfth wavelength. A signal is connected in series to a feed-point located at the mid-point of the first side. A first gap is located at the mid-point of the third side and is a first fraction of the wavelength in length. The second sub-element has a total length of approximately one-half wavelength in a substantially rectangular shape. The second sub-element comprises fifth and seventh sides, each having a length of approximately one-sixth wavelength; and sixth and eighth sides, each having a width of approximately one-twelfth wavelength. A second gap of the first fraction in length is located at the mid-point of the seventh side. The first side of the first sub-element is positioned in parallel and spaced a second fraction of the wavelength apart from the fifth side of the second sub-element, such that the first and second sub-elements are magnetically coupled.

Other aspects of the invention are that the first and second sub-elements are conductors of wire, rod, tubing or printed circuit trace. The combination of the first and second sub-elements results in a higher feed-point impedance, a lower conductor resistance loss, and a broader bandwidth than a single sub-element. The antenna element has a feed-point impedance suitable for connection directly to a 50 ohm transmission line. The first and second sub-elements may be positioned in the same plane or positioned in different planes at an angle to each other.

The antenna element may also include a plurality of second sub-elements positioned in parallel and in different planes at an angle to the plane containing the first side of the first sub-element. This antenna element has an adjustable feed-point impedance based on the number of second sub-elements and the aspect ratio of the sub-elements relative to the first sub-element.

A multi-band antenna may be formed by positioning a plurality of these antenna elements parallel to each other and with each antenna element dimensioned to operate at a different operating frequency. In this case, the feed-point for each antenna element is connected to a common signal.

In another embodiment of invention, the antenna element also comprises first and second sub-elements. The first sub-element has a total length of approximately one-half wavelength in a substantially step-like shape. The first sub-element comprises sequentially first, second, and third sections, each having a length of approximately one-sixth wavelength. A signal is connected in series to a feed-point located at the mid-point of the second section. The second sub-element has a total length of approximately one-half wavelength in a substantially step-like shape. The second sub-element comprises sequentially fourth, fifth, and sixth sections, each having a length of approximately one-sixth wavelength. The first and second sub-elements are transposed relative to each other such that the first section of the first sub-element is positioned in line with the sixth section of the second sub-element and the third section of the first sub-element is positioned in line with the fourth section of the second sub-element. The second section of the first sub-element is spaced a fraction of the wavelength apart from the fifth section of the second sub-element, such that the first and second sub-elements are magnetically coupled.

Other aspects of this embodiment are that the antenna element produces an electric field polarization that is vertical when operating at a first frequency, $f_1$; horizontal when operating at a second frequency, $f_2$; and horizontal when operating at a third frequency, $f_3$, where $f_3>f_2>f_1$. The second section of the first sub-element and the fifth section of the second sub-element may be vertical and parallel, the first and second sub-elements may lie in parallel planes and the second section of the first sub-element is positioned at an angle to the fifth section of the second sub-element, or alternatively, the second section of the first sub-element and the fifth section of the second sub-element are curved apart such that the mid-points of the second section and fifth section are spaced further apart than the ends of the second and fifth sections.

A directive antenna may be formed from a plurality of these antenna elements. In the directive antenna one of the plurality of antenna elements is a driven element, while the remainder are parasitic elements that are not driven by the signal source. At least one parasitic element is positioned in parallel on a first side of the driven element to act as a reflector element. The remainder of the parasitic elements are positioned in parallel on a second side of the driven element to act as a director elements. The configuration of these elements provides enhanced directivity over that of a single element.

Still another embodiment of invention is a ground plane antenna comprising first and second sub-elements. The first sub-element has a total length of approximately one-quarter wavelength comprised of sequentially first, second, and third sections. The first section extends vertically upwards from a ground plane. The second section extends horizontally, parallel to the ground plane. The third section extends vertically down towards the ground plane. The end of the third section forms a gap with the ground plane a first fraction of the wavelength in length. A signal is connected to a feed-point between the first section and the ground plane. A plurality of second sub-elements are used, each having a total length of approximately one-quarter wavelength and comprising sequentially first, second, and third sections. The first section connects to and extends vertically upwards from the ground plane. The second section extends horizontally, parallel to the ground plane. The third section extends vertically down towards the ground plane. The end of the third section forms a gap with the ground plane the first fraction of the wavelength in length. The plurality of second sub-elements is disposed symmetrically and in parallel around the first sub-element and are spaced a second fraction of the wavelength apart from each neighboring sub-element. This combination of the first and second sub-elements results in a reduced physical height without discrete loading elements and a higher feed-point impedance than a single sub-element.

Still other objects and advantages of the invention will in part be obvious and will in part be apparent from the specification and the drawings.

BRIEF DESCRIPTION OF THE DRAWING

For a more complete understanding of the invention, reference is made to the following description and accompanying drawing, in which.

DETAILED DESCRIPTION OF THE PREFERRED EMBODIMENTS

The preferred embodiments of the apparatus and method according to the present invention will be described with reference to the accompanying drawings.

Figure 1:
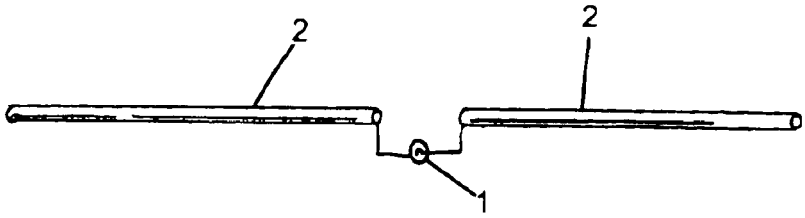
FIG. 1 (PRIOR ART)
FIG. 1 is a short dipole antenna as taught in the prior art.
Figure 2:
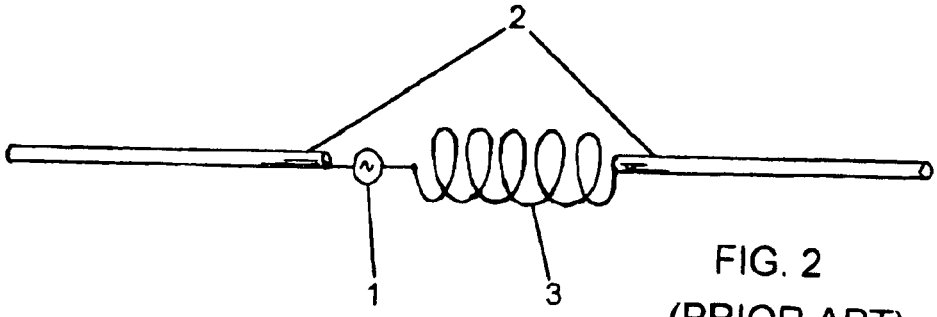
FIG. 2 (PRIOR ART)
FIG. 2 is a short dipole antenna with an inductor as taught in the prior art.
Figure 3:
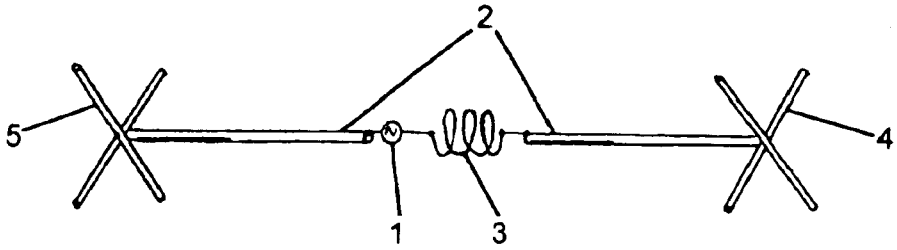
FIG. 3 (PRIOR ART)
FIG. 3 is a prior art antenna with capacitive end-loading of the dipole.
Figure 4:
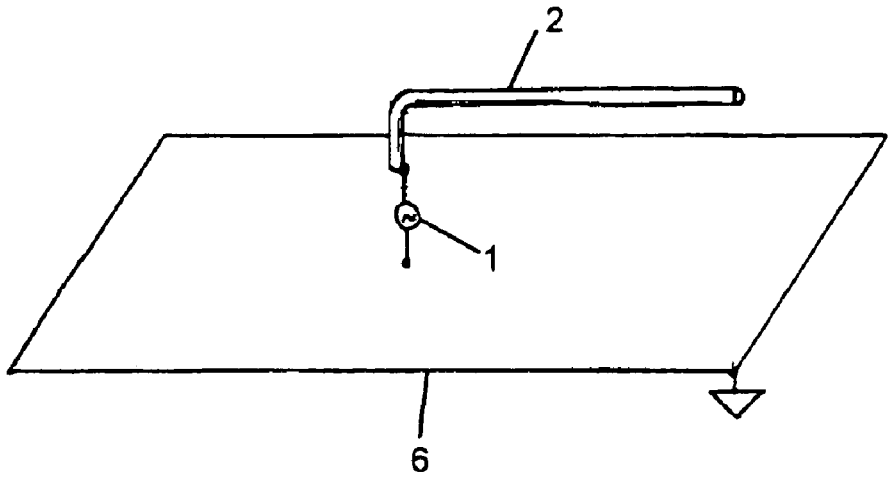
FIG. 4 (PRIOR ART)
FIG. 4 is a prior art inverted L antenna.
Figure 5:
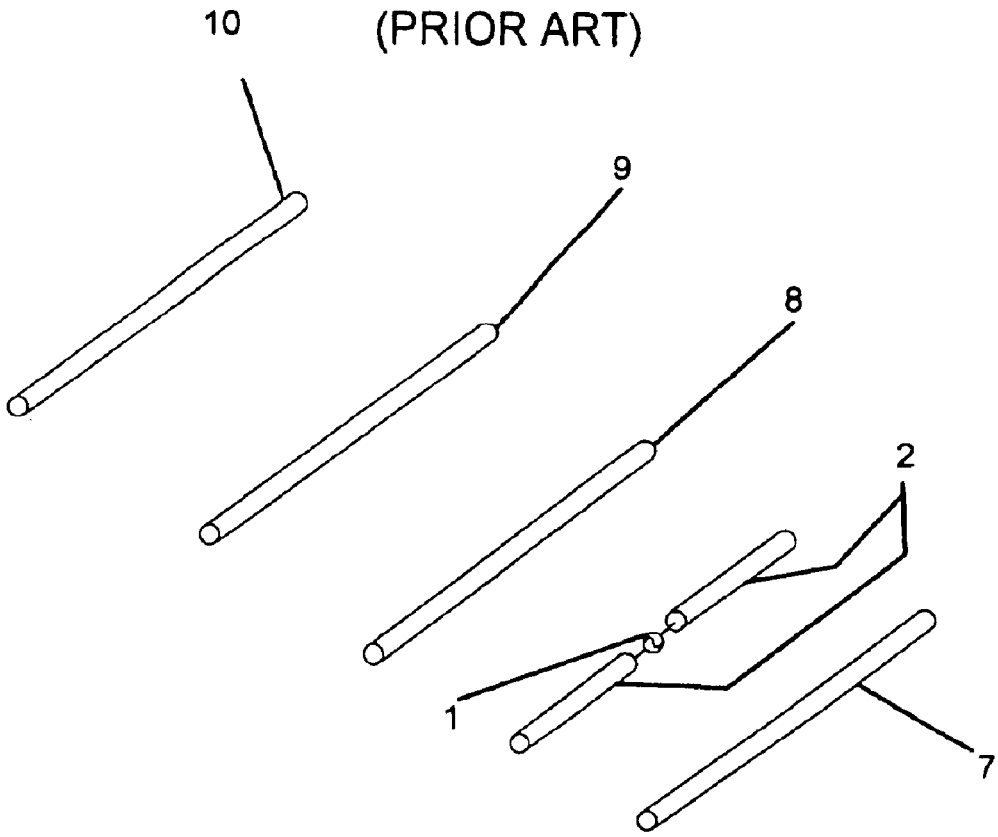
FIG.5 (PRIOR ART)
FIG. 5 is a prior art single band yagi antenna consisting of an array of spaced elements.
Figure 6:
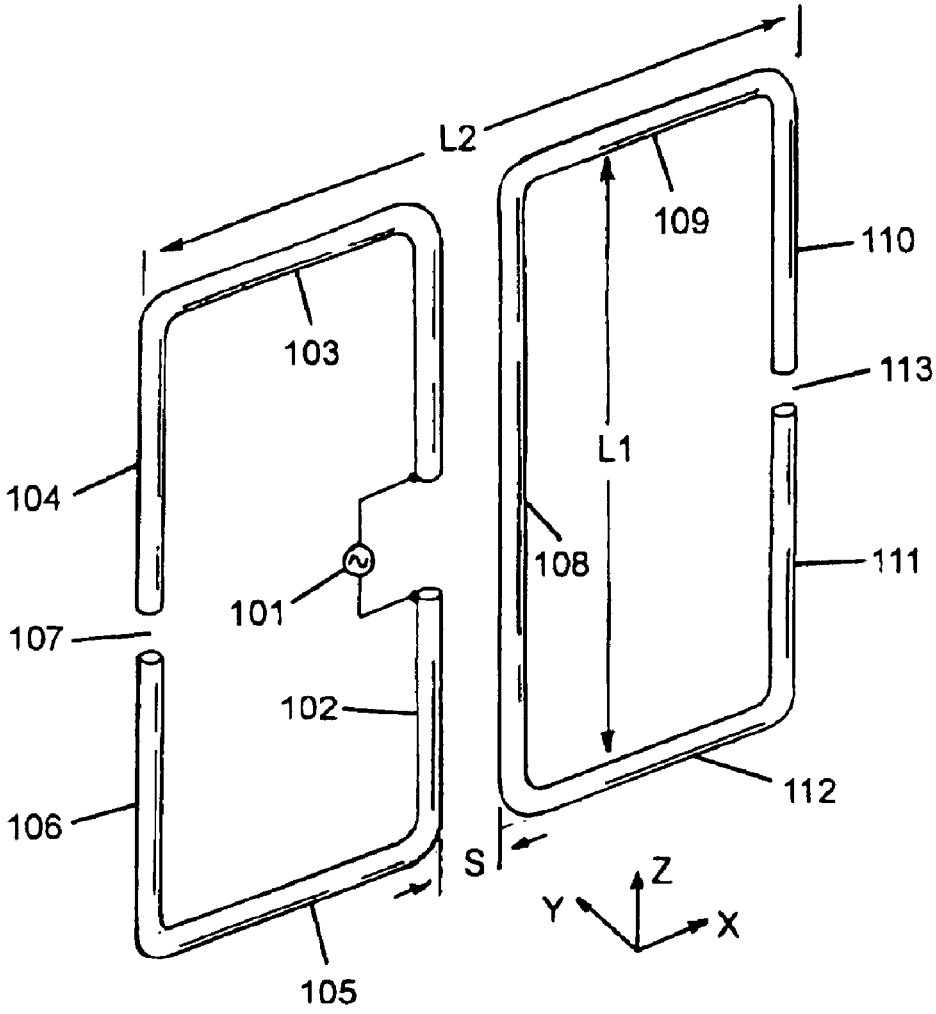
FIG. 6 is a shaped antenna element in accordance with the teaching of the present invention.
Figure 7:
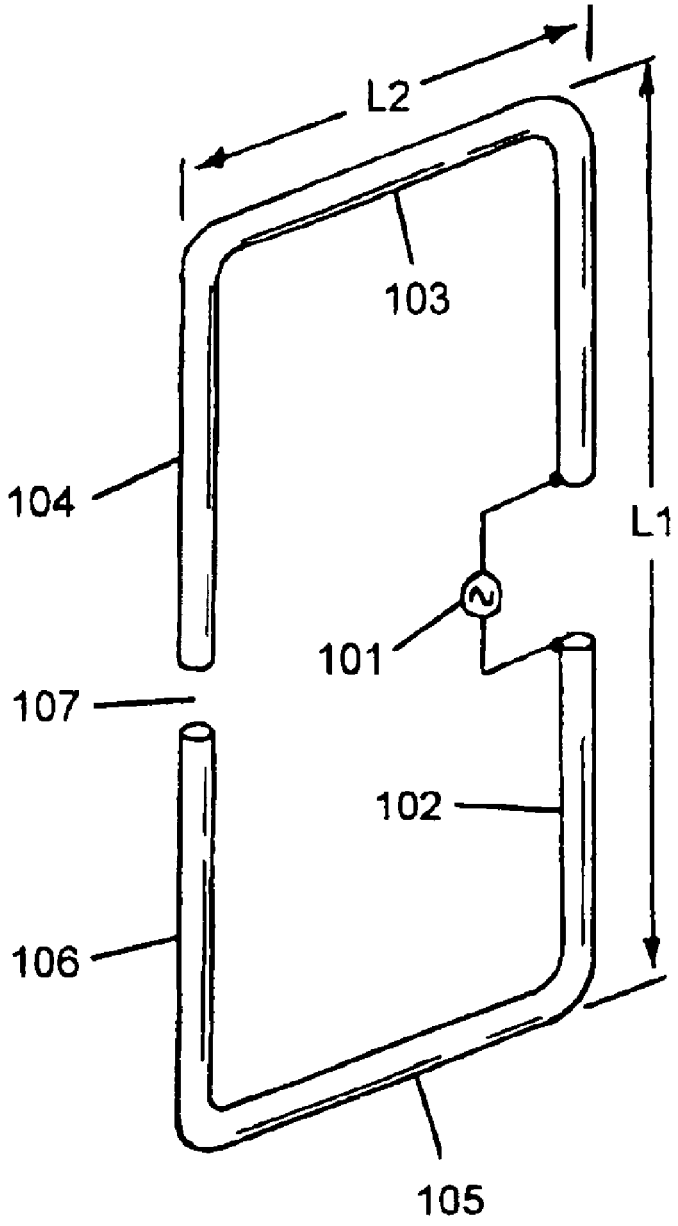
FIG. 7 shows the details of the driven sub-element of the antenna shown in FIG. 6.
Figure 8:
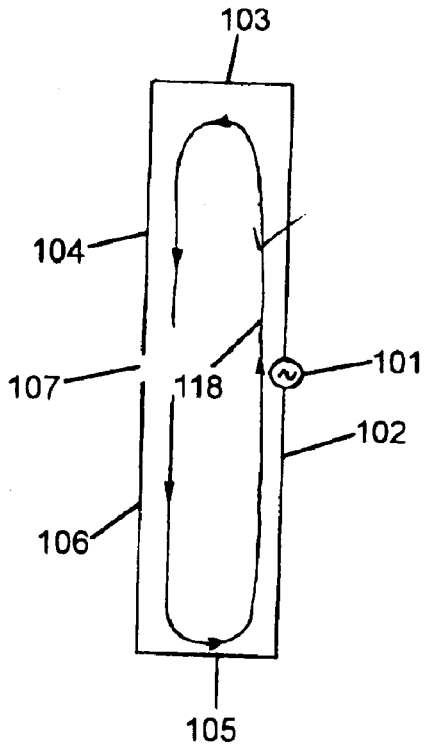
FIG. 8 is a simplified view of the driven sub-element of the antenna shown in FIG. 6.

In accordance with the present invention, a specially shaped antenna element is disclosed, consisting of at least two substantially similar sub-elements, that is physically much smaller than a half-wave dipole yet exhibits an input resistance that is controllable by design and can be similar in magnitude to that of a full size half-wave dipole. An example of the first embodiment of the invention is shown in FIG. 6. It consists of two substantially identical sub-elements, each of which is formed from conductive wire, rod, tube or printed circuit trace, having a diameter or width of between approximately 0.0001λ and 0.01λ, where λ is the operating wavelength corresponding to the operating frequency. Each sub-element consists of a single conductive element, consisting of 102, 103, 104, 105 and 106 in the first sub-element, and 108, 109, 110, 111 and 112 in the second sub-element. The sub-elements are folded in the form shown in FIG. 6, such that there is a gap, 107, in the first sub-element, and 113 in the second sub-element. Each gap is a small fraction of the total length of each sub-element The first sub-element (the 'driven' sub-element), is driven by a radio frequency voltage source 101 connected to the center of 102, either directly as shown or via a coaxial cable. It should be noted that, for clarity, the feed point in segment 102 of FIG. 6 is shown much wider than typically used in practice. The second sub-element (the 'parasitic' sub-element) is coupled to the driven sub-element principally via magnetic coupling between the close parallel sections, 102 and 108. The spacing S between 102 and 108 is less than approximately 0.05λ. For clarity, the element shown in FIG. 6 is simply the element itself, without any supporting means. Support of the sub-elements in the required position may be provided, for example, by fixing the sub-elements to a structural member fabricated from a low-loss dielectric material that forms the gap S, in FIG. 6, between the two sub-elements. Use of a suitable material, in either solid or tubular form, has negligible effect on the operation of the element. FIG. 7 shows the details of the driven sub-element. The source voltage, 101, is connected to the center section, 102, of the driven sub-element. For a feed-point impedance of 50 ohms, the dimension L1 is approximately $$\frac{\lambda}{6}$$

at the operating frequency. Other feed-point impedances may be achieved by a suitable change in the dimension L1. The total length of the sub-element is the sum of the lengths of sections 102, 103, 104, 105 and 106 and is approximately 0.5λ. FIG. 8 shows a simplified view of the driven sub-element. The arrow, 118, shows the direction of current flow when the sub-element is driven at the resonant frequency, $f_1$, of the sub-element. The currents in the top and bottom horizontal segments of the sub-element flow in opposite directions, so the radiated fields from these currents cancel. The principle radiation field is vertically polarized and is generated by the current flow in the vertical section, 102, modified somewhat by the smaller amplitude anti-phase currents in segments 104 and 106 of the sub-element. The radiation resistance of the sub-element shown in FIG. 7 is given approximately by:

$$R_r = 45\left(\frac{\pi \times L1}{\lambda}\right)^2$$

where $R_r$ is the radiation resistance (ohms);

L1 is the length of segment 102 (meters); and

λ is the operating wavelength (meters).

For the case where the vertical dimension L1 in FIG. 7 is equal to $$\frac{\lambda}{6},$$

the corresponding radiation resistance is approximately 12.5 ohms.

Figure 9:
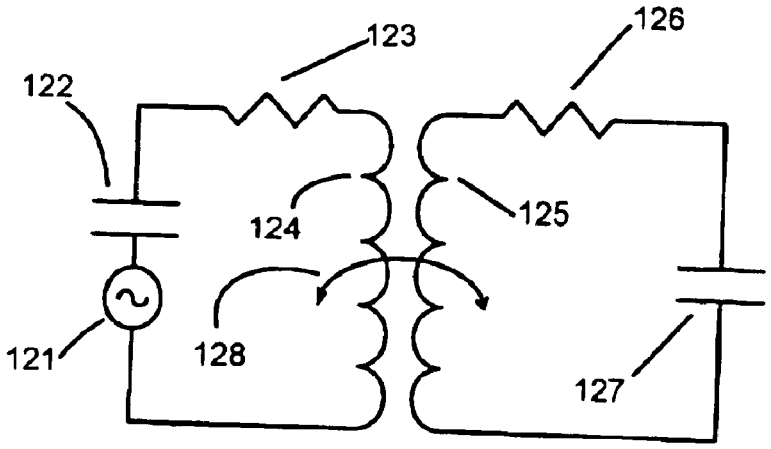
FIG. 9 is a circuit representation of the antenna shown in FIG. 6.

The addition of the parasitic sub-element, as depicted in FIG. 6, modifies the element operation as follows. The two sub-elements, which are substantially identical in size and shape, behave as an over-coupled pair of tuned circuits, as depicted in FIG. 9. In FIG. 9 the self-inductances of the driven and parasitic sub-elements are represented by 124 and 125 respectively, the self-capacitances by 122 and 127, and the radiative loss resistances by 123 and 126. The source of radio frequency voltage 121 is connected in series with the tuned circuit equivalent of the driven sub-element. Magnetic coupling between the driven and parasitic sub-elements is shown via the coupling arrows 128 linking inductances 124 and 125 in FIG. 9. Referring back to FIG. 6, at the operating frequency, the spacing S between segments 102 and 108 is such that the two tuned circuits are over-coupled. That is, their coupling coefficient is greater than the critical value. It is known from the prior art of over-coupled tuned circuits that the two coupled circuits have two resonant frequencies, one above and the other below the natural resonant frequency of each identical tuned circuit. The spacing of the two resonances from the natural resonant frequency increases as the coupling between the two circuits increases. It is also known from the prior art that, at the lower resonant frequency, the currents in segments 102 and 108 in FIG. 6 are almost equal in amplitude and almost equal in phase. Also, at the upper resonant frequency, the currents in 102 and 108 in FIG. 6 are almost equal in amplitude but opposite in phase. The close spacing S of the two sub-elements is such that, from a radiation pattern standpoint, at the lower resonant frequency segments 102 and 108 in FIG. 6 can be considered to be co-sited. That is, the radiation pattern produced by the two currents in the conductors is indistinguishable from that of the vector sum of the two currents flowing in a single wire occupying their mean position. The resultant radiation pattern and directivity generated by these currents is very close to that of a short dipole having a constant current over its length. The directivity relative to an isotropic radiator is approximately 1.8 dBi, as compared to the directivity of a half-wave dipole of 2.14 dBi.

The effect of the two substantially equal amplitude and in-phase currents flowing in segments 102 and 108 in FIG. 6 is to increase the feed-point impedance of the driven sub-element. This may be seen as follows. The power radiated by segments 102 and 108 in FIG. 6 is proportional to the square of the magnitude of the vector sum of the two currents. The power input to the driven sub-element is proportional to the square of the magnitude of the current flowing in the driven segment of the driven sub-element. In the general case, where the currents in segments 102 and 108 of FIG. 6 are not equal in amplitude and phase, the feed point resistance at the operating frequency is given by:

$$R_{in}=R_r(1+k^2+2k\cos\phi)$$

where $R_{in}$ is the feed-point resistance, $R_r$ is the radiation resistance of one sub-element at the operating frequency, k is the ratio of the amplitude of the current in the center of segment 108 to that of the current in the center of segment 102 in FIG. 6, and $\phi$ is the phase angle between the currents in 108 and 102.

For the case where the currents are of equal amplitude and phase, the feed-point resistance is:

$$R_{in}=4\times R_r$$

For the case where the currents are equal in amplitude but in anti-phase, the feed-point resistance is:

$$R_{in}=\text{zero}$$

One skilled in the art will recognize that the expression above for the element feed-point resistance, where the currents are equal in amplitude and in phase, is exactly that obtained by using a conventional 'folded dipole' antenna element. The case of the folded dipole is, in fact, a special example of the general case of over-coupled antennas having arbitrary current amplitudes and phases in the sub-elements.

As a result of the approximately equal amplitude and in phase currents in the driven and parasitic sub-elements, the feed-point resistance of the driven element is raised from approximately 12.5 ohms for a single sub-element, to approximately four times this value, or 50 ohms, for the two coupled sub-elements. A commonly used coaxial cable having a characteristic impedance of 50 ohms may be used to drive the antenna, with zero reflected power. The first embodiment of the invention therefore allows the use of elements that are one-third of the length of a full-size halfwave dipole, while providing an excellent impedance match to a 50 ohm cable without the use of loading reactances or of any external impedance matching circuit. In addition, any resistive power loss caused by currents flowing in the sub-elements is reduced by a factor of two when compared with the power loss in a single prior art element because the current in each sub-element is one half of the current flowing in a prior art single element for the same radiated power. It should be noted that, by suitable adjustment of the lengths of segments 102 and 108 in FIG. 6, the feed-point resistance may be adjusted in order to match a wide range of desired characteristic impedances.

In similar fashion, the feed-point impedance at the lower resonant frequency for an element consisting of n identical coupled sub-elements is equal to $n^2$ times the radiation resistance of one sub-element.

The major dimension of the element disclosed in the first embodiment of the invention is $$\frac{\lambda}{6}.$$

It will be clear from FIG. 6 that a vertical dimension L1 of $$\frac{\lambda}{6}$$

results in a horizontal width L2, also of approximately $$\frac{\lambda}{6}.$$

Figure 10:
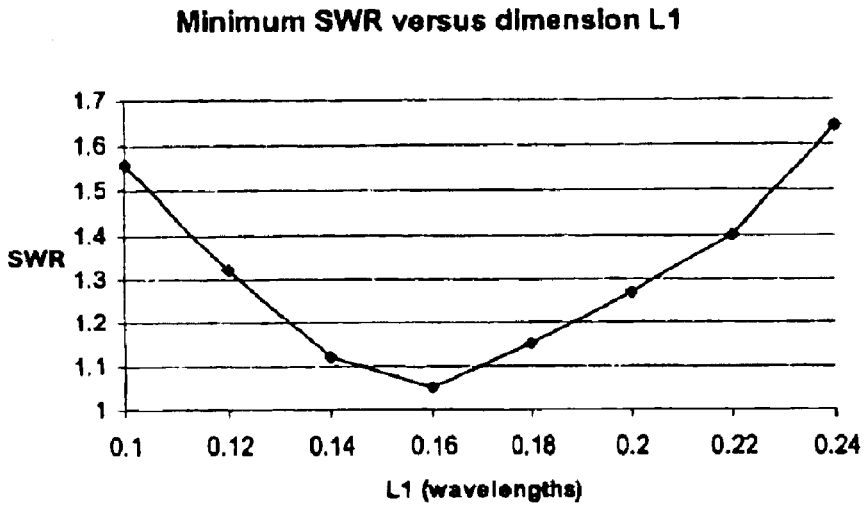
FIG. 10 is a plot of the SWR (standing wave ratio) at the resonant frequency for a shaped antenna element in accordance with the teaching of the present invention.

Although these dimensions will provide an excellent match to 50 ohm cable, the dimensions that give a practically acceptable match are not at all critical. FIG. 10 shows a plot of the SWR (standing wave ratio) at the resonant frequency for an element constructed according to the first embodiment, as a function of the dimension L1 in FIG. 6. FIG. 10 shows that the SWR at the feed-point remains below 1.7:1 for dimensions L1 in FIG. 6 of from 0.1λ to 0.24λ. These dimensions correspond to a horizontal width L2 in FIG. 6 of from 0.3λ to <0.1λ, respectively. It can be seen that the antenna element according to the first embodiment allows great freedom in the choice of dimensions while still retaining the advantages of a good match to a 50 ohm cable. As an illustrative example of the relative dimensions of a half-wave dipole and an element according to the first embodiment of this invention, a half-wave dipole element for the 14 MHz amateur band has a length of approximately 33 feet. An element according to the first embodiment of this invention has a length of approximately 11 feet, and a width of approximately 11 feet.

Figure 11:
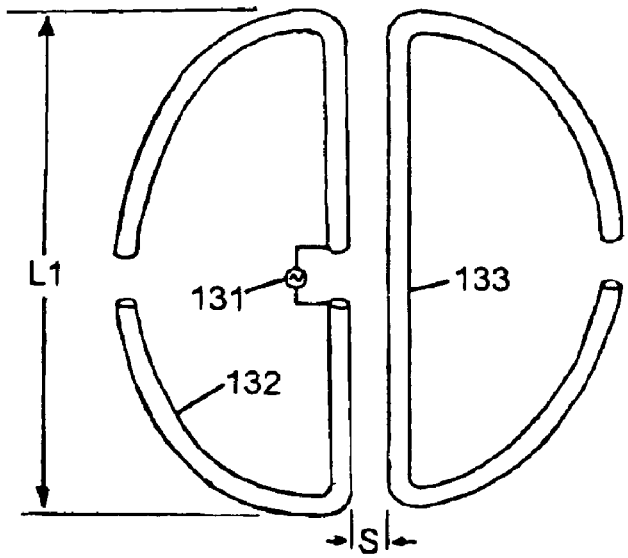
FIG. 11 illustrates that the antenna elements shown in FIG. 6 can be formed into any convenient shape.
Figure 12:
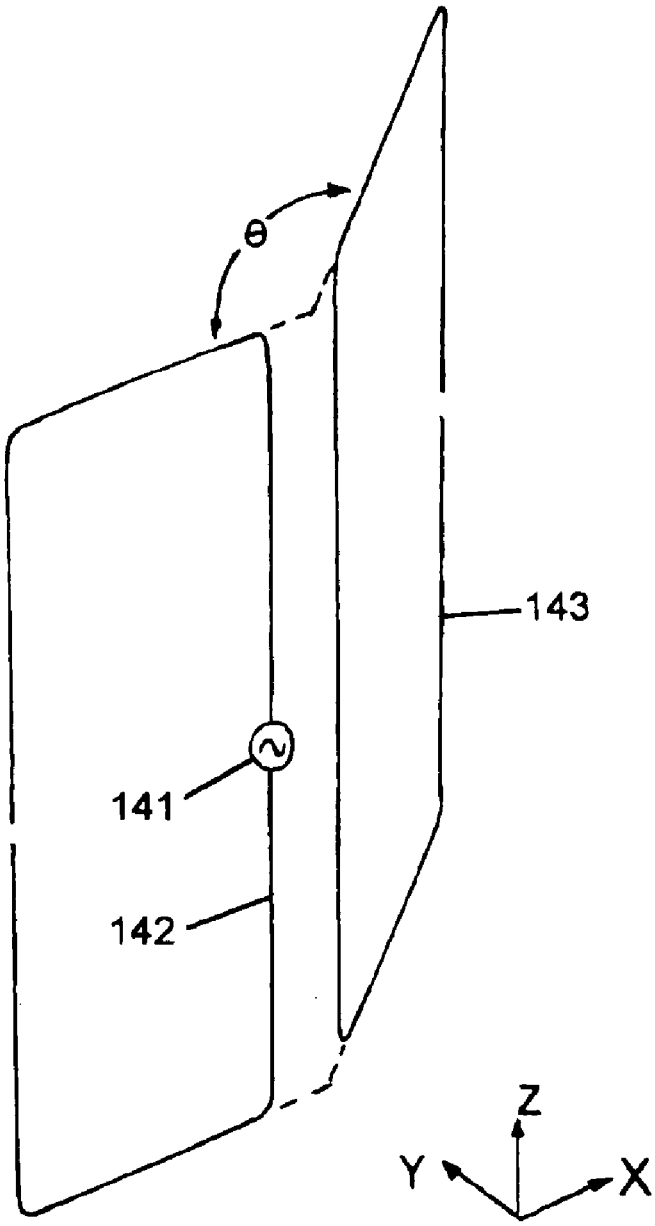
FIG. 12 is a shaped antenna element where the planes containing the two sub-elements are at an angle relative to each other.

In order to clarify the relationship between the resonant frequency of each of the sub-elements, to the operating frequency, it should be noted that the operating frequency is lower than the resonant frequency by an amount that depends on the coupling factor between the two sub-elements, but in general the operating frequency will be up to about 20 percent lower than the resonant frequency. This example of the first embodiment of the invention should not be construed as limiting to the invention. The segments 103, 104, 105 and 106, and the gap 107 in the driven sub-element and the segments 109, 110, 111 and 112, and the gap 113 in the parasitic sub-element in FIG. 6 can alternatively be formed to any convenient shape. For example, as illustrated in FIG. 11, where each sub-element 132 and 133 is formed into the shape of the periphery of a semi-circle. Also, FIGS. 6 and 7 show the two sub-elements as being co-planar in the X-Z plane. In some circumstances it may be desirable to construct the element as shown in FIG. 12, where the planes containing the two sub-elements 142 and 143 are at an angle, θ. Such construction has very little effect on operation for angles θ between 30 degrees and 330 degrees. Also, the examples of the first embodiment of the invention illustrated here show an antenna element oriented so that the polarization is vertical That is, the electric field is predominantly vertical. The azimuthal radiation pattern is essentially omni-directional. It will be clear to those skilled in the art that the element may be oriented to produce horizontal polarization, or any desired angle between horizontal and vertical. In addition, elements may also be constructed that use reflection from a ground plane to replace the lower half of the element in the same way that a prior art "ground plane" antenna is fashioned. By adjusting the dimensions of such an antenna it is possible to achieve a very good match to a 50 ohm feed cable.

Figure 13:
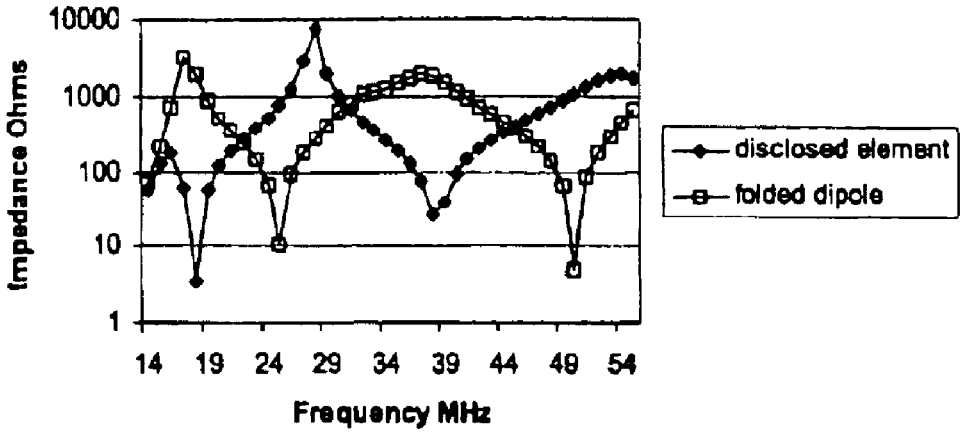
FIG. 13 is a graph of the feed-point impedance of a folded dipole element compared with that of an element according to the disclosed invention.

Yet another advantage of the antenna element disclosed in the first embodiment is the ability of the element to be used in an array of parallel-connected elements constituting a multi-band antenna. Parallel-connected half-wave dipoles are well known in the prior art as a method of providing multi-band operation without the inconvenience and cost of switching equipment. An important factor to consider when using parallel antennas is the feed-point impedance of the non-resonant antennas compared to that of a resonant antenna. Unless the non-resonant antenna impedance is substantially higher than that of the resonant antenna, a serious mismatch can occur that renders the antenna useless. A classic folded dipole can again be folded in the same fashion as the sub-element shown in FIG. 7 and will provide a similar feed-point impedance to that of the element in FIG. 6. But, the element cannot be used in a parallel-connected antenna system at a frequency at or near twice its resonant frequency. This is a well-known drawback of the folded dipole and is caused by a resonance that occurs in the short-circuited transmission lines that are part of the folded dipole itself. At the fundamental resonance, the short-circuited transmission lines are each $$\frac{\lambda}{4}$$

long, so the short circuit is transformed essentially to an open circuit that does not impede normal operation at the fundamental frequency. However, at the second harmonic, the transmission lines are now $$\frac{\lambda}{2}$$

long and the short circuits are not transformed. They appear as short circuits across the feed-point, thereby rendering any parallel element with a close resonance unusable. This is not the case with the first embodiment of the present invention, and operation of parallel elements at the second harmonic of one element is practical. An element according to the first embodiment of the present invention does have a resonant frequency at which the feed-point impedance is very low, but this corresponds to the upper frequency of the two resonances associated with the over-coupled sub-elements. The frequency at which this low feed-point resistance occurs is relatively close to the fundamental frequency and may be moved away from a desired resonant frequency simply by changing the coupling coefficient, effected principally by changing the spacing S in FIG. 6, without altering the basic qualities of the element. This cannot be done with a folded dipole element. As an illustrative example of this desirable quality, FIG. 13 shows a plot of the feed-point impedance of a folded dipole element compared with that of an element according to this invention. Both elements have a fundamental resonance at 14 MHz, with a resonant impedance of approximately 50 ohms. From FIG. 13 the serious drop in feed-point impedance of the folded dipole for several MHz near the second harmonic can be seen, whereas the element herein disclosed has a very high impedance extending over a wide frequency range that encompasses the problem frequencies of the folded dipole. The plot clearly shows the low feed-point impedance of the element herein disclosed caused by the upper frequency resonance of the over-coupled sub-elements at approximately 18 MHz.

Figure 14:
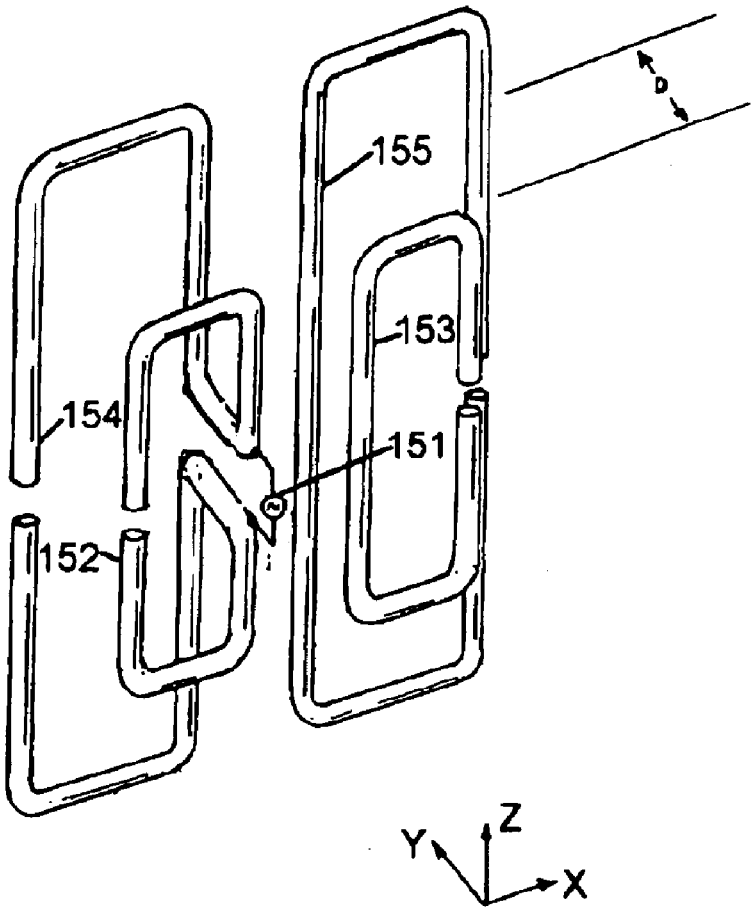
FIG. 14 is an illustrative example of the present elements in a dual-band antenna.
Figure 15:
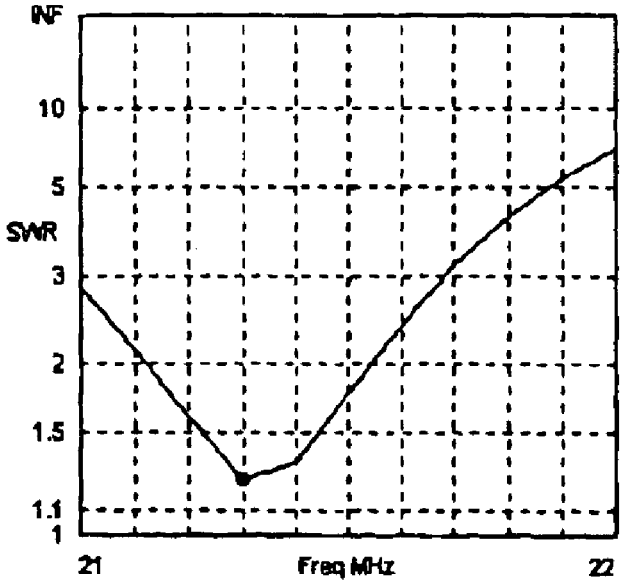
FIG. 15 is a plot of the SWR for a dual-band antenna constructed as shown in FIG. 14, operating in the 21 MHz band.
Figure 16:
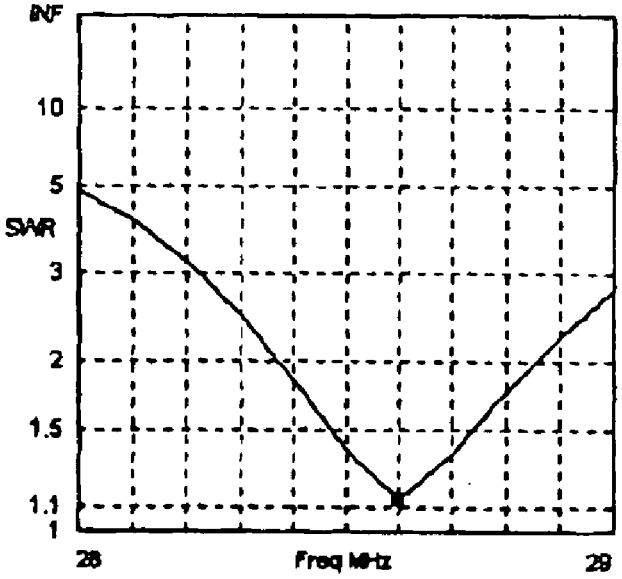
FIG. 16 is a plot of the SWR for a dual-band antenna constructed as shown in FIG. 14, operating in the 28 MHz band.

An illustrative example of how the first embodiment of the invention may be used in a dual-band antenna is shown in FIG. 14. In FIG. 14, two elements, the first element consisting of sub-elements 152 and 153 with a higher operating frequency and the second element consisting of sub-elements 154 and 155 with a lower operating frequency, are driven in parallel by the source 151. The spacing D between the planes containing the two elements need be no more than a few inches for operating frequencies in the region of 10 MHz to 30 MHz. FIGS. 15 and 16 show plots of the SWR for an antenna constructed as shown in FIG. 14, designed for the 21 MHz and 28 MHz bands, and using $1/8^{th}$ inch diameter copper wire for the elements. The maximum dimension of this antenna is a little less than 9 feet, or 0.19λ at the lowest operating frequency, and the efficiency, in free space, is greater than 97%.

Yet another advantage of the present invention is that the frequency of operation may be adjusted simply by changing the total length of each sub-element, preferably by adding or removing conductors at the gaps, 107 and 113 in FIG. 6, or for cases where the sub-elements are made of self-supporting rod, tubing, or printed circuit trace, adjustment may be made by means of screwed or telescoping sections wherein the total length of the sub-elements may be easily adjusted. This is not so simple with a folded dipole element, where a connection must first be broken, the conductor added or removed, and the connection re-made. It should also be noted that the operating frequency varies with the spacing S in FIG. 6, because the coupling factor varies with S. This allows for tuning of the element operating frequency without changing the sub-element lengths. In practice, a tuning range of a few percent of the operating frequency may easily be obtained with negligible effect on the operating frequency SWR.

Figure 17:
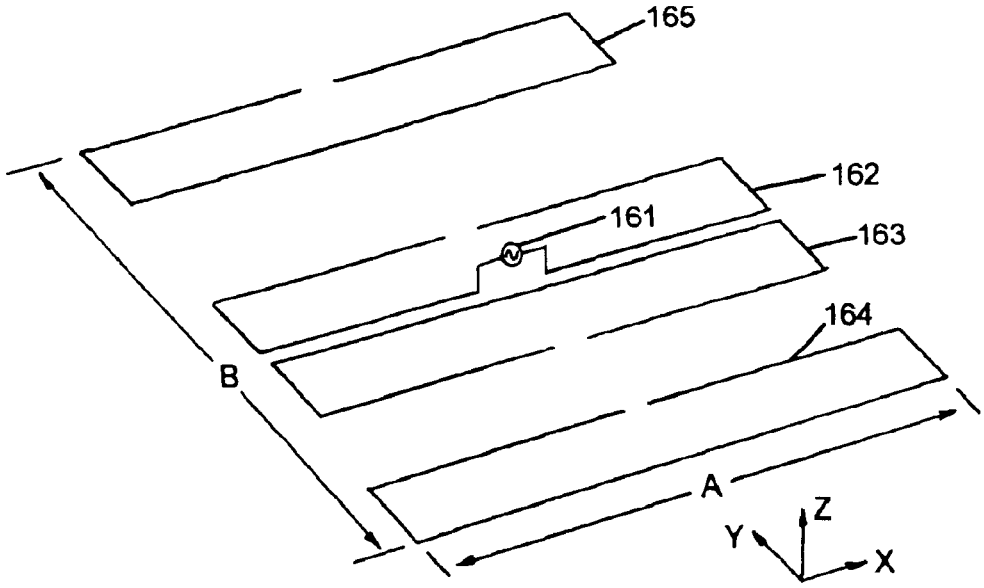
FIG. 17 is a schematic illustration of a 3 element directional antenna according to the present invention and similar in form to a yagi antenna.

As a further example of the use of the invention, FIG. 17 illustrates in schematic form a 3 element directional antenna of similar form to that of a yagi antenna, but with the conventionally-used half-wave dipole elements replaced with elements and sub-elements according to the first embodiment of the invention. In FIG. 17, a source of radio-frequency voltage 161 is connected either directly, as shown, or via a coaxial cable to the center of the driven element consisting of sub-elements 162 and 163. A reflector sub-element 164 is placed behind the driven element and a director sub-element 165 is placed in front of the driven element. Note that only one sub-element is required for the reflector and one for the director, since impedance multiplication is not needed in the director and reflector sub-elements. The spacing of the elements is generally similar to that of conventional full-size yagi antennas. Although for clarity, details of the support system for the elements in FIG. 17 are not shown. This follows conventional practice for yagi antennas wherein the elements are mounted to a boom of larger diameter than the elements. The parasitic sub-element 163, the reflector 164, and the director 165 may be directly connected to the boom without insulators. The driven sub-element 162 must be supported via insulating standoff supports. The performance of an antenna designed using the above principles for the 50 MHz frequency band is as follows:

| | |
|---|---|
| Operating frequency | 50.5 MHz |
| Forward Gain | 8.36 dBi |
| Front - to - back ratio | 23 dB |
| Front - to - sidelobe ratio | 21 dB |
| 2:1 SWR bandwidth in a 50 ohm system | 1 MHz |
| Antenna width (dimension A in FIG. 17) | 58 inches (0.25 λ) |
| Antenna length (dimension B in FIG. 17) | 117 inches (0.5 λ) |

Figure 18:
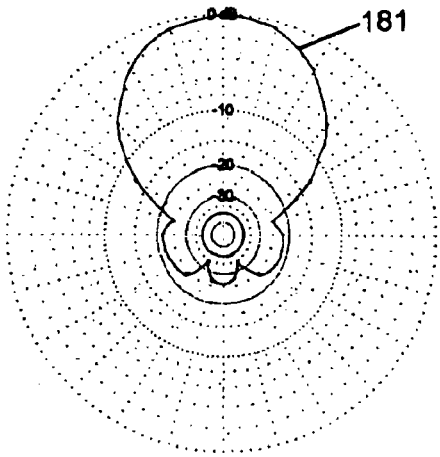
FIG. 18 is a radiation pattern for an antenna similar to that shown in FIG. 17.
Figure 19:
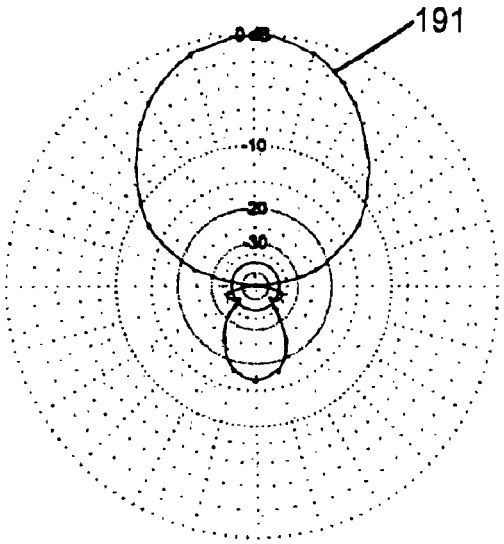
FIG. 19 is an E field radiation pattern for an antenna similar to that shown in FIG. 17 and designed for acceptable sidelobes.
Figure 20:
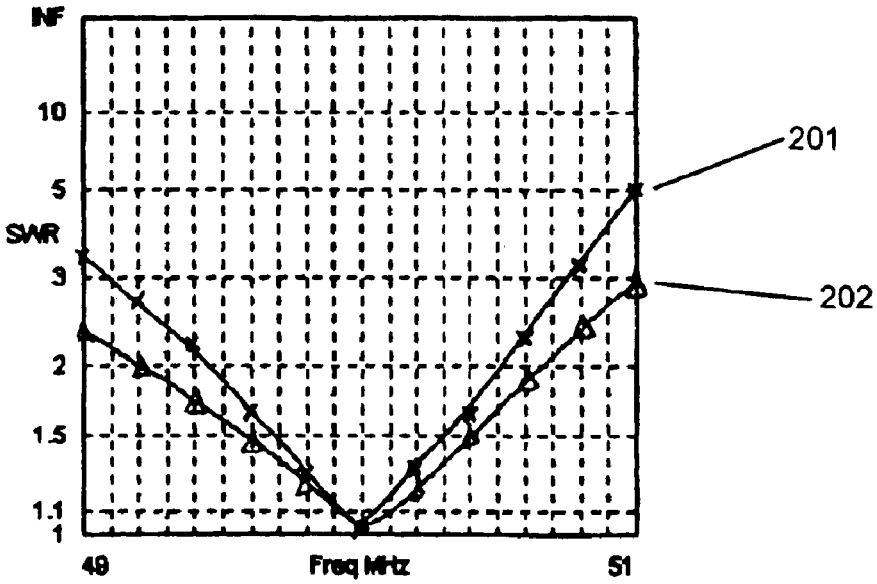
FIG. 20 is a comparison plot of the SWR curve for an antenna similar to that shown in FIG. 17 and a conventional yagi.

This performance is achieved without the use of external impedance matching circuits. It should be noted that the driven and parasitic sub-elements are longer than $$\frac{\lambda}{6}$$

in order to raise the feed-point impedance to 50 ohms. It is well known in the art that coupling from the reflector and directors into the driven element in conventional yagi antennas causes a reduction in the feed-point resistance that must be corrected by means of matching systems. The same effect is present in the yagi antenna based on the first embodiment of this invention, but matching is achieved simply by suitably designing the dimensions of the driven element. An E field radiation pattern is shown in FIG. 18, where 181 is the E field plot. A conventional yagi antenna having 3 full size elements and a length of 0.5λ has a maximum gain of approximately 9.2 dBi, but at maximum gain has unacceptably high sidelobes. When designed for acceptable sidelobes, such an antenna produces an E field pattern as shown in FIG. 19, where 191 is the E field plot. The gain of the full-size yagi is approximately 8.7 dBi. The width of a full size 3 element yagi operating at 50 MHz is approximately 116 inches (0.49λ), or approximately twice the width of the antenna described herein. The penalty for reducing the width is a loss in gain of approximately 0.34 dB. The feed-point impedance for the conventional yagi is approximately 25 ohms and requires a matching system, with attendant complexity and power loss, to allow connection to a 50 ohm source. FIG. 20 shows a comparison plot of the SWR curve for the two antennas; 201 for the antenna based on the invention in a 50 ohm system, and 202 for a conventional full size yagi in a 25 ohm system. The full size yagi has a 2:1 SWR bandwidth that is 400 kHz wider than that of the antenna based on the first embodiment (i.e. 1.4 MHz versus 1 MHz). For most applications this reduction in SWR bandwidth is acceptable. From the foregoing examples it may thus be seen that the invention has many advantages over the prior art in the field of antenna design, and is applicable to a wide range of antenna systems.

Figure 21:
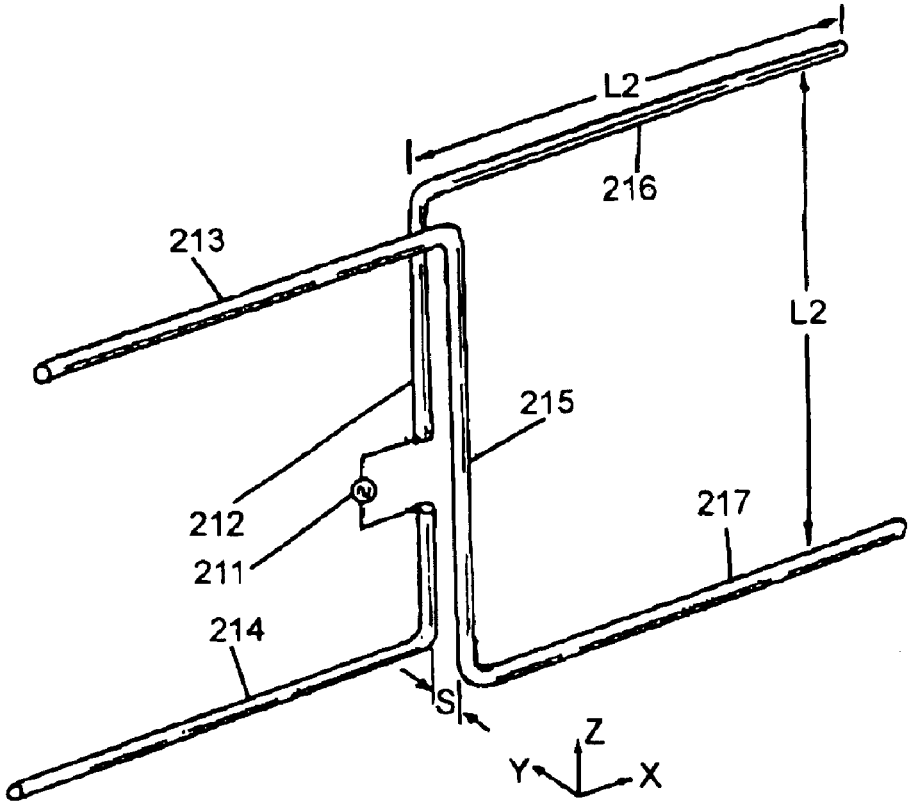
FIG. 21 shows a second embodiment of a shaped antenna element in accordance with the teachings of the present invention.
Figure 22:
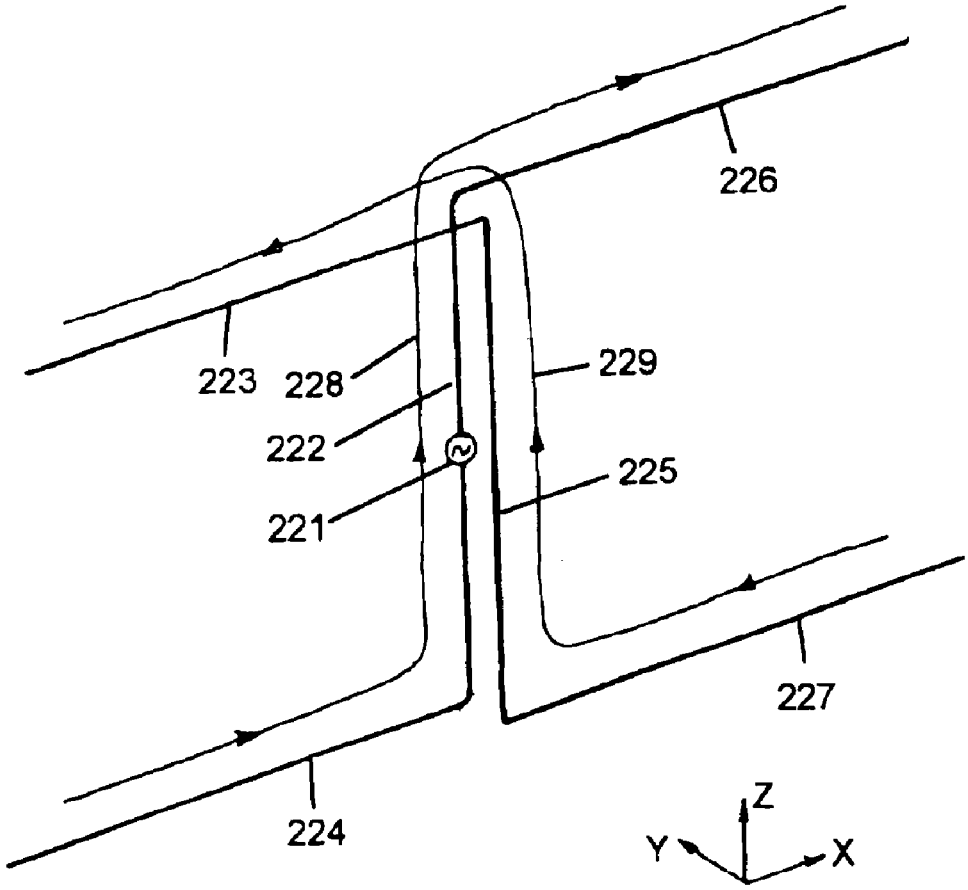
FIG. 22 is a simplified view of the element of FIG. 21 showing the direction of current flow.

A second embodiment of the invention is derived from and closely related to the above-described embodiment. FIG. 21 shows this second embodiment. The source of radio frequency voltage is connected either directly, as shown in FIG. 21, or via coaxial cable to the center of the driven sub-element consisting of segments 212, 214 and 216. An identical parasitic sub-element, consisting of segments 213, 215 and 217, is closely coupled to the driven sub-element via magnetic coupling between segments 212 and 215. The spacing S between segments 212 and 215 is typically less than 0.05λ, and the lengths L1 and L2 in FIG. 21 are approximately $$\frac{\lambda}{6}$$

at the fundamental frequency. The coupling between the two sub-elements and the method by which the feed-point impedance is increased is exactly as described in the first embodiment. However, it will be noted that the uppermost horizontal segment of the driven sub-element 216 and the uppermost segment of the parasitic sub-element 213 are transposed and are not bent in the form shown in FIG. 6. The effect of these modifications is to produce an element that is useful at two frequencies. In order to understand operation at these two frequencies, first consider the element's behavior at the lower resonant frequency, $f_1$. FIG. 22 is a simplified view of the element of FIG. 21, with arrows 228 and 229 depicting the direction of current flow in the various segments. From the description of the first embodiment, the currents in the close parallel segments 222 and 225 are in phase at $f_1$. From this, the currents in the upper horizontal segments 223 and 226 are in anti-phase, as are those in the lower horizontal segments 224 and 227. The current phases are such that the radiation field from the horizontal segments 223, 224, 226 and 227 cancel each other and the net resultant field is generated by the currents in segments 222 and 225. This results in a vertical omni-directional E field, as in the first embodiment. The feed-point impedance is also multiplied as in the first embodiment.

Figure 23:
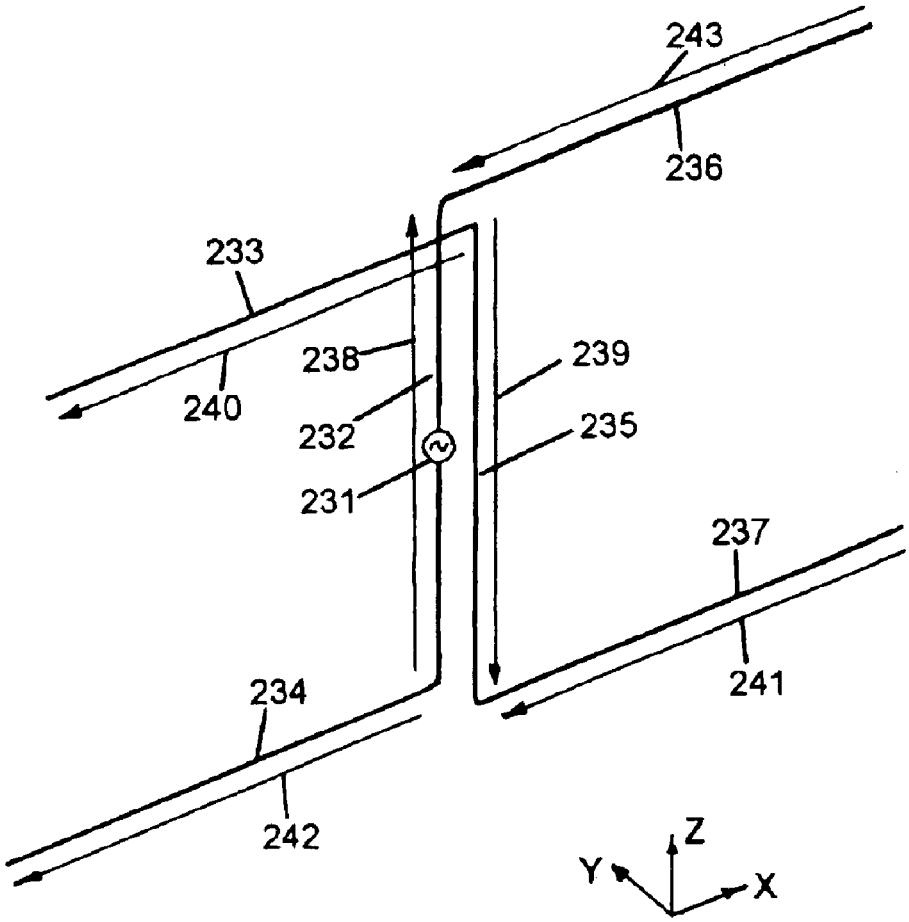
FIG. 23 is a simplified view of the element of FIG. 21 showing the direction of current flow at the third harmonic frequency.
Figure 24:
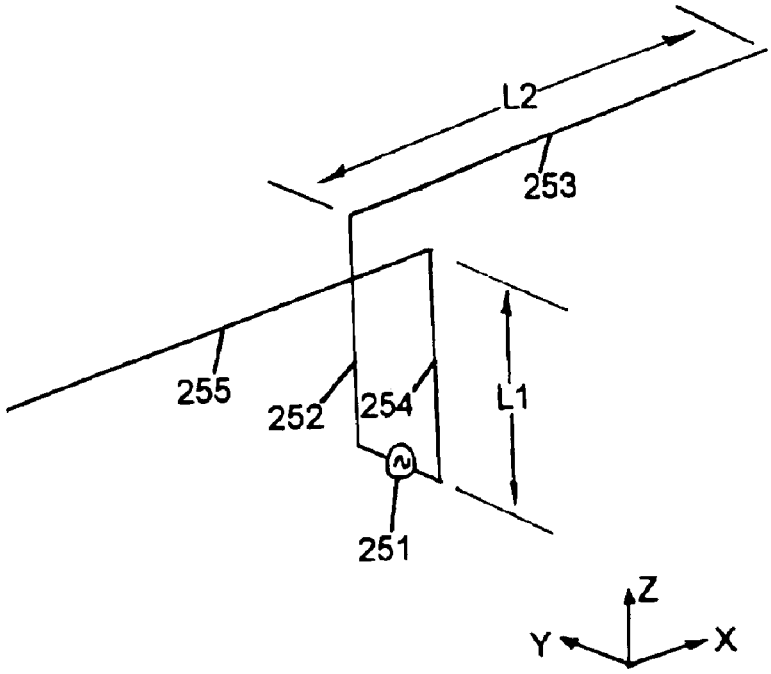
FIG. 24 is a detailed view of the top half of the element depicted in FIG. 23.

Now consider the current phases at a frequency $f_3$ that is close to the third harmonic of $f_1$. The total length of the segments in each sub-element is now $$\frac{3\lambda}{2},$$

and since there is a current phase reversal in each $$\frac{\lambda}{2}$$

segment, the current phases change to those shown in FIG. 23. The horizontal segments 233, 234, 236 and 237 are now each $$\frac{\lambda}{2}$$

long. In FIG. 23, currents in the driven sub-element segments 232, 234 and 236 are indicated by arrows 238, 242 and 243 respectively, and in the parasitic sub-element segments 235, 233 and 237 by arrows 239, 240 and 241 respectively. From these it can be seen that the currents in the horizontal segments 233, 234, 236 and 237 in FIG. 23 are all in phase, whereas the currents in the vertical segments 232 and 235 are in anti-phase. The vertical E field radiation from segments 232 and 235 is therefore cancelled, and the resulting E field is generated by segments 233, 234, 236 and 237 and is horizontally polarized. In addition, since the segments 233, 234, 236 and 237 in FIG. 23 are spaced from each other both vertically and horizontally, the resulting E field has substantial directivity when compared to that of a half-wave dipole. In order to calculate the feed-point impedance at $f_3$, note that the element is symmetrical about the center of segments 232 and 235 in FIG. 23. The top half of the element depicted in FIG. 23 is re-drawn in FIG. 24. In FIG. 24, the source 251 is connected to segments 252 and 254. The length L1 of segments 252 and 254 is $$\frac{\lambda}{4}$$

at $f_3$. The ends of the segments 252 and 254 in FIG. 24 are connected to segments 253 and 255, each of which has a length, L2, of $$\frac{\lambda}{2}$$

at $f_3$. Thus the source, 251, drives the two half-wave long segments, 253 and 255, via a $$\frac{\lambda}{4}$$

transmission line made up of segments 252 and 254. The two half-wave segments, 253 and 255, present a relatively high resonant impedance to the $$\frac{\lambda}{4}$$

line, but as is well known in the art the $$\frac{\lambda}{4}$$

line made up of segments 252 and 254 acts as an impedance transformer so that the feed-point impedance presented to the source 251 may be adjusted to a suitable value by changing the characteristic impedance $Z_0$ of the $$\frac{\lambda}{4}$$

line. This may be done by changing the spacing between segments 252 and 254 in FIG. 24, or by changing the diameter or width of the conductors in 252 and 254, or by a little of both. By these means the feed-point impedance may be adjusted so that its value at $f_3$ is the same as that at $f_1$. The feed-point impedance for the complete element, as illustrated in FIG. 21, is twice that of the half-element depicted in FIG. 24, since both halves are connected in series. The resulting element has qualities that are extremely useful in the design of a dual-band directive antenna that produces a vertically polarized radiation pattern at $f_1$ and an enhanced gain horizontally polarized radiation pattern at $f_3$. Those skilled in the art will recognize the general arrangement depicted in FIG. 21 as resembling, at least superficially, a prior art antenna known as the "Lazy H." Although the essential and important difference is that the Lazy H is always parallel fed and with such a feed arrangement the benefits of operation at the fundamental frequency are not available. As an example of the performance of an element according to the second embodiment of the invention, the following are design and performance data for an element designed for use as the driven element in a dual band directive antenna. For this antenna, which uses a yagi-like structure as heretofore explained, it is necessary for the feed-point impedance at the two operating frequency bands to be equal and substantially larger than 50 ohms in order that the mutual coupling between the driven element and the parasitic elements produces a final feed-point impedance of 50 ohms. The element detailed below was designed for a feed-point impedance of 125 ohms and the SWR data are related therefore to a reference resistance of 125 ohms:

| | |
|---|---|
| design center frequencies | 144 MHz and 432 MHz |
| diameter of elements | 0.002 λ at 144 MHz |
| L1 (in FIG. 21) | 0.18 λ at 144 MHz |
| L2 (in FIG. 21) | 0.14 λ at 144 MHz |
| S (in FIG. 21) | 0.01 λ at 144 MHz |
| minimum SWR at 144 MHz | 1.06:1 |
| 2:1 SWR bandwidth at 144 MHz | 11 MHz |
| gain at 144 MHz | 1.84 dBi |
| E field polarization at 144 MHz | vertical |
| minimum SWR at 432 MHz | 1.1:1 |
| 2:1 SWR bandwidth at 432 MHz | 49 Mhz |
| gain at 432 MHz | 8 dBi |
| E field polarization at 432 MHz | horizontal |

Note that the gain at 144 MHz is as expected for a short dipole, and the gain at 432 MHz is almost 6 dB higher than a $$\frac{\lambda}{2}$$

dipole, as may be expected for what is effectively 4 stacked dipoles fed in phase.

Figure 25:
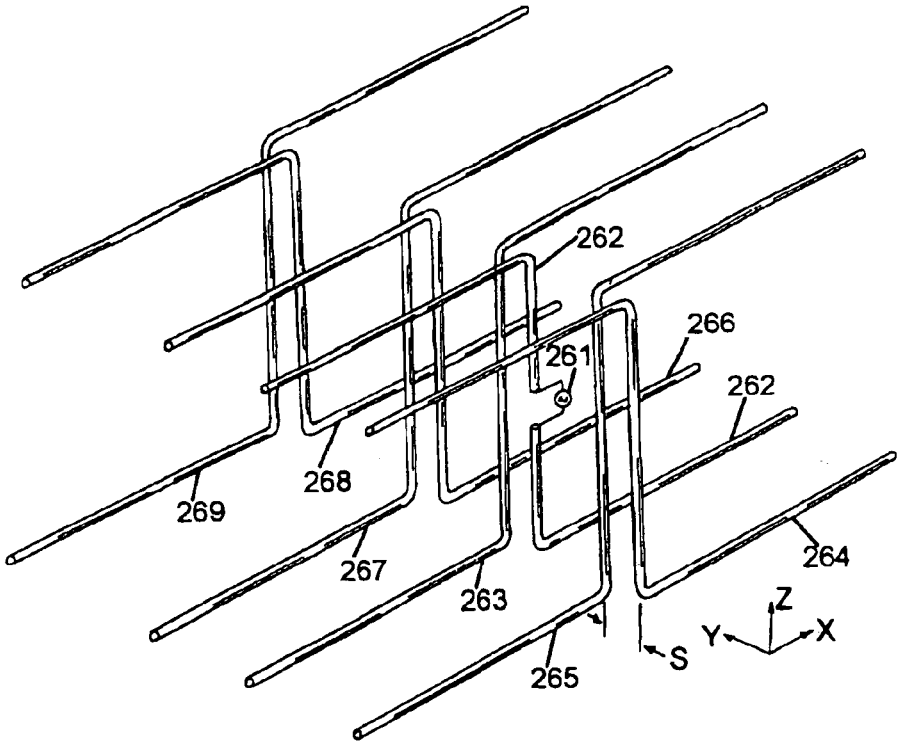
FIG. 25 is a directional yagi antenna based on the element shown in FIG. 21.

The above results show that the element is ideally suited for use as the driven element in a directive antenna of the yagi type. Such an antenna based on the above element is shown in FIG. 25. In FIG. 25, the source of radio frequency power drives the center of the sub-element 262 which, together with the parasitic sub-element 263 comprise the driven element of the antenna. Sub-elements 264 and 265 comprise the reflector element, and the sub-elements 266 and 267, and 268 and 269, make up the first and second director elements, respectively. Dimensions of the horizontal segments of the sub-elements generally follow those of conventional yagi elements at $f_3$, as does the spacing between the reflector, 264 and 265, and driven element, 262 and 263, and the two directors, 266 and 267, and 268 and 269, and the driven element. In general, the length of the horizontal segments of the reflector sub-elements is a few percent longer than that of the horizontal segments of the driven element. The horizontal segments of the first director, 266 and 267, are generally a few percent shorter than those of the driven element, and those of the second director, 268 and 269, are a few percent shorter than those of the first director. Those skilled in the art will recognize that the spacing of the elements at $f_1$ is much closer than conventional yagi theory would dictate. The close spacing in an antenna according to the second embodiment is permissible because, at $f_1$, the mutual impedance between the elements at a given spacing is substantially lower than for conventional full-size elements.

Figure 26:
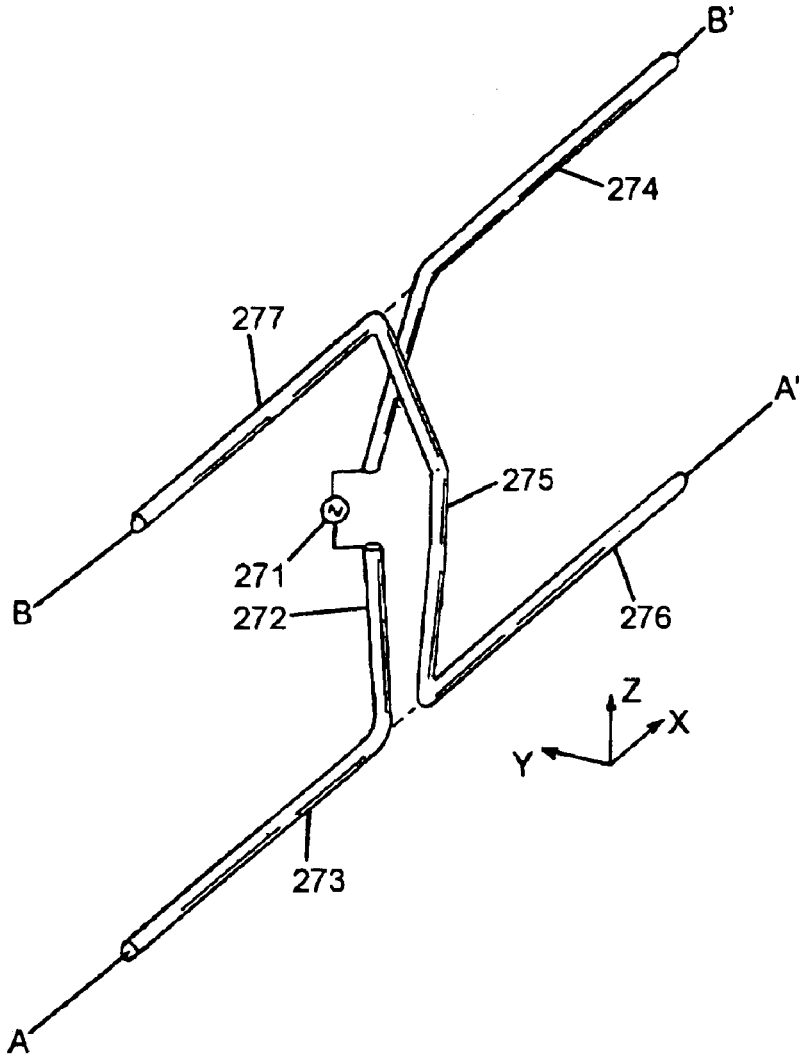
FIG. 26 is a variant of the element shown in FIG. 21 where the centers of the sub-elements are spaced along the y-axis.

For clarity, FIG. 25 does not show details of how the sub-elements may be supported. Normally, a metallic boom would be used as a support. Such a boom, lying in the Y direction, would support the centers of the vertical sections of the sub-elements. Although in theory only the driven sub-element needs to be insulated from the boom, it is more desirable to insulate all the sub-elements, especially if the boom and sub-elements are of a material that will corrode. Under corrosion conditions varying contact resistance between the boom and sub-elements can cause erratic tuning of the antenna and can also cause noise under windy conditions. The antenna shown in FIG. 25 is limited to 4 elements in order to clarify its construction. For use at 144 MHz and 432 MHz, element dimensions are such that more elements are practical without making the antenna difficult to handle or problematic in terms of wind loading. Although the antenna illustrated in FIG. 25 is capable of excellent performance at both $f_1$ and $f_3$, the directivity at $f_3$ may be improved by a simple modification to the elements. From the illustration in FIG. 25, it can be seen that the horizontal segments of the sub-elements may be considered to form 4 stacked yagi antennas. However, since the sub-elements of each element are spaced along the Y axis by the spacing S the radiation pattern from each side-by-side pair of yagi antennas is skewed by the phase difference introduced by the spacing S. Since the skew is in one direction for the upper horizontal elements and in the opposite direction for the lower horizontal elements, the skew does not produce an asymmetric radiation pattern but does increase the sidelobes and reduces the gain slightly when operating at $f_3$, both of which, although not serious, are undesirable. This may be corrected by using the element assembly shown in FIG. 26. Here the centers of the sub-elements are spaced along the Y axis as in FIG. 25, but the vertical segments 272 and 275 in FIG. 26 are formed so that the segments 277 and 274 of the upper horizontal sections are on the same axis, B–B', and the lower horizontal sections made up of segments 273 and 276 are on the same axis A–A'. This is achieved by a simple twisting of segments 272 and 275, and does not affect the element operation at either frequency, except in the desired manner at the third harmonic.

The following data were obtained from antennas of 8 and 15 elements designed using the general methods given above:

| Physical data: | | |
|---|---|---|
| Number of elements | 8 | 15 |
| Antenna length | 0.4 λ at 144 MHz<br>1.2 λ at 432 MHz | 1.15 λ at 144 MHz<br>3.45 λ at 432 MHz |
| Max. width (reflector width) | 0.34 λ at 144 MHz<br>1.024 λ at 432 MHz | 0.34 λ at 144 MHz<br>1.024 λ at 432 MHz |
| Max. height | 0.176 λ at 144 MHz<br>0.53 λ at 432 MHz | 0.176 λ at 144 MHz<br>0.53 λat 432 MHz |
| Performance data: | | |
| Gain at 144 MHz | 8.1 dBi | 11.4 dBi |
| Gain at 432 MHz | 14.4 dBi | 17.1 dBi |
| Gain at 144 MHz (full size, same length) | 8.4 dBi | 12.2 dBi |
| Gain at 432 MHz (full size, same length) | 12.3 dBi | 15.8 dBi |
| SWR at 144 MHz | 1.1:1 | 1.4:1 |
| 2:1 SWR bandwidth at 144 MHz | 8 MHz | 8 MHz |
| SWR at 432 MHz | 1.1:1 | 1.2:1 |
| 2:1 SWR bandwidth at 432 MHz | 28 MHz | 26 MHz |

Figure 27:
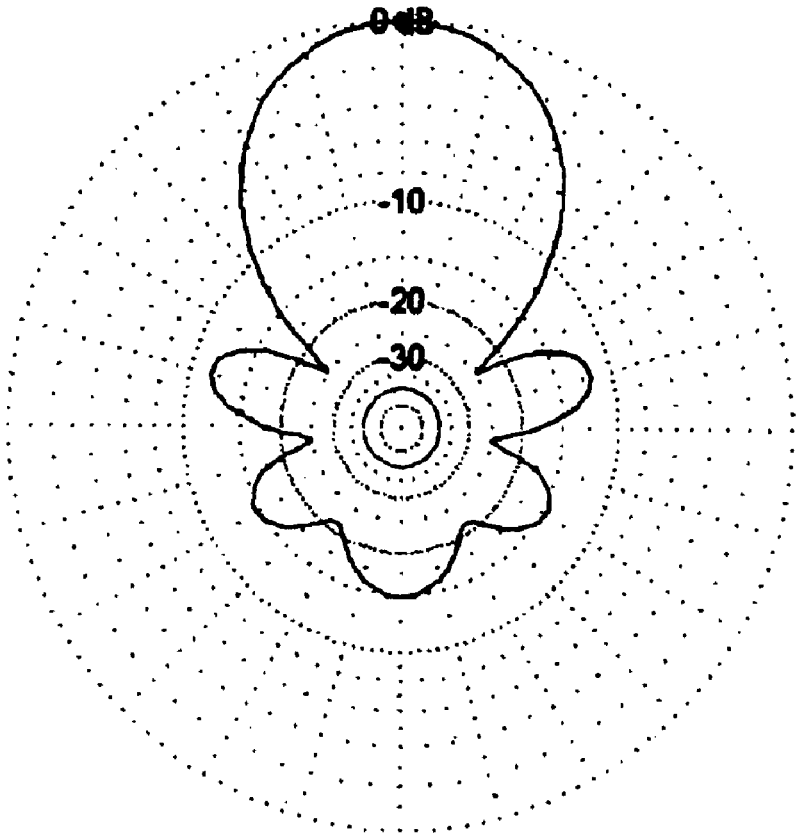
FIG. 27 shows the radiation pattern for a 15-element antenna according to the second embodiment of present invention at 144 MHz.
Figure 28:
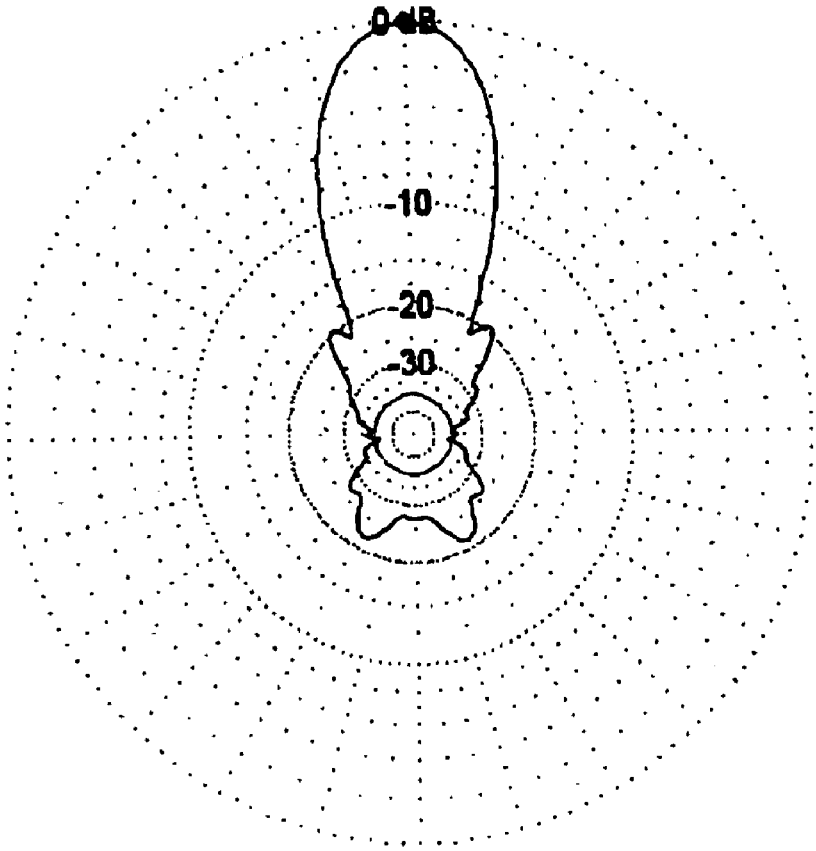
FIG. 28 shows the radiation pattern for a 15-element antenna according to the second embodiment of present invention at 432 MHz.
Figure 29:
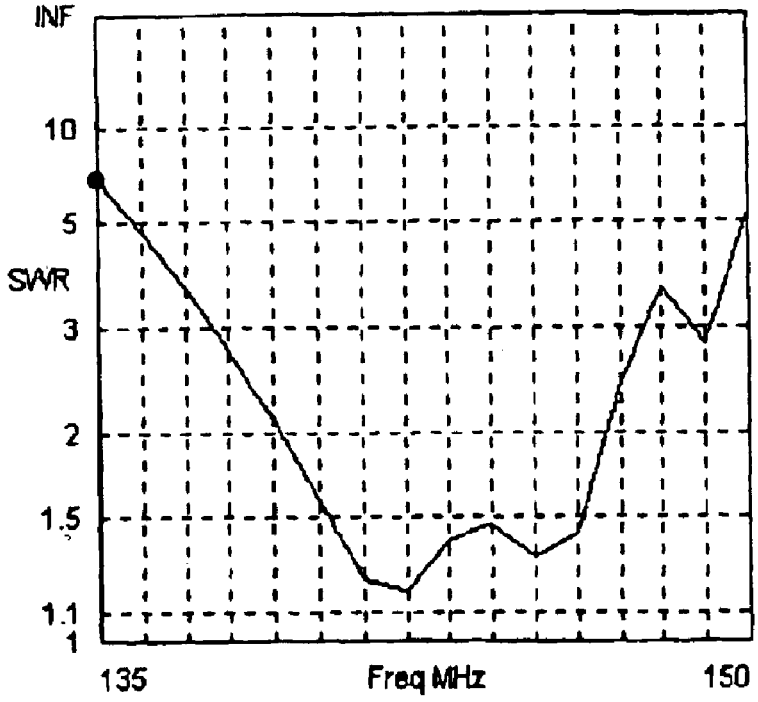
FIG. 29 shows a SWR plot for a 15-element antenna according to the second embodiment of present invention at 144 MHz.
Figure 30:
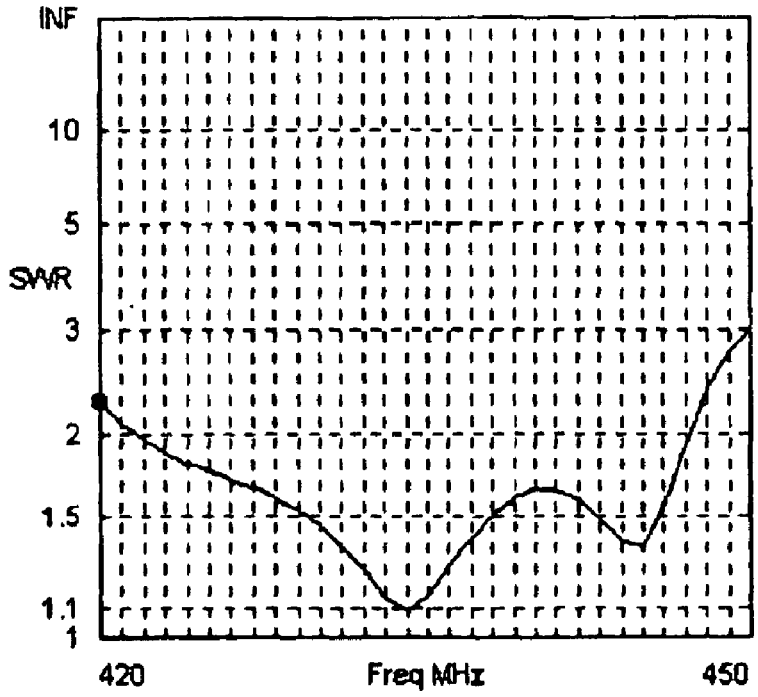
FIG. 30 shows a SWR plot for a 15-element antenna according to the second embodiment of present invention at 432 MHz.

There are several points to note about the above data:

1) At 144 MHz, both the 8 element and 15 element antennas provide less gain than that of a full size yagi, but the deficit is a maximum of 0.8 dB in the 15 element case. This is as expected for short elements.
2) The 8 element antenna provides a gain at 432 MHz that is 2.1 dB more than for a full size yagi. This means that a full size yagi would need to be twice as long as the antenna based on the second embodiment, with the attendant increase in wind load.
3) The 15 element antenna provides a gain of 1.3 dB more than that of a full size yagi. The antenna according to the second embodiment has a length of 7 feet 9 inches, whereas a full size yagi would need to be 11 feet 5 inches long to provide the same gain. The gain advantage of this example of an antenna based on the second embodiment gradually becomes smaller as the length of the antenna becomes longer. This is because the capture cross-sections of the equivalent 4 stacked yagis begin to overlap, and it is known from stacked antenna theory that the stacking distance needs to be increased as the antenna length increases in order to achieve maximum gain. However, over a sizeable range of antenna lengths, it will be recognized that the antenna based on the second embodiment can produce very significant gain advantages over an antenna using prior art design methods. Techniques that stack individual yagis that are individually fed require complex power splitting, phasing and matching circuits that are totally avoided in the disclosed invention.
4) The antenna according to the second embodiment also has the advantage of operating on two bands without matching networks and switching systems, with their attendant loss, and it requires only one feeder cable.
5) The performance of the antennas that are examples of the second embodiment of the invention, in terms of radiation pattern and SWR bandwidth, is excellent. As examples, these data for the 15 element antenna are shown in FIGS. 27, 28. 29 and 30, where FIG. 27 shows the E field pattern at 144 MHz, FIG. 28 shows the E field pattern 432 MHz, FIG. 29 shows the SWR plot at 144 MHz and FIG. 30 shows the SWR plot at 432 MHz, both in a 50 ohm system.

Using similar techniques to those heretofore disclosed, directive antennas operating on many different closely-harmonically-related frequencies may be produced. For example, one such antenna can operate on 50 MHz and 144 MHz with similar advantages to those outlined above.

Those skilled in the art will appreciate that the elements described in the first and second embodiments of the invention have wide application to antenna systems that would conventionally use full-size halfwave dipoles as the core element. This is also true for antennas based on the ground plane principal that replaces the lower half of the element(s) with a mirror image reflection in a ground plane or the equivalent thereof. Also, those skilled in the art will realize that in many conventional yagi designs it is desirable to use a folded dipole as a driven element. This allows the use of a simple half wave transmission line 4:1 balun to provide a balanced drive to the driven element. This same technique may be applied to the disclosed invention by replacing the driven sub element by its folded dipole equivalent, and using a balun as the balancing device to provide balanced drive. For antennas that are operating at frequencies such that the upper frequency is approximately three times the lower frequency, the use of a balun where the transmission line length is a half wave at the lower frequency will also provide correct balun operation at the upper frequency.

A third embodiment of the invention is an antenna that consists of any number of similarly shaped elements arranged so as to provide high directivity. The element consists of two similarly shaped sub-elements that are modified versions of the elements disclosed hereinabove. Referring back to FIG. 6, at the operating frequency the spacing S between segments 102 and 108 is such that the two tuned circuits are over-coupled. That is, their coupling coefficient is greater than the critical value. It is known from the prior art of over-coupled tuned circuits that the two coupled circuits have two resonant frequencies, one above and the other below the natural resonant frequency of each identical tuned circuit. The spacing of the two resonances from the natural resonant frequency increases as the coupling between the two circuits increases. It is also known from the prior art that, at the lower resonant frequency, $f_1$, the currents in segments 102 and 108 in FIG. 6 are almost equal in amplitude and almost equal in phase. Also, at the upper resonant frequency, $f_2$, the currents in 102 and 108 in FIG. 6 are almost equal in amplitude but opposite in phase. The close spacing S of the two sub-elements is such that from a radiation pattern standpoint at $f_1$, segments 102 and 108 in FIG. 6 can be considered to be co-sited. That is, the radiation pattern produced by the two currents in the conductors is indistinguishable from that of the vector sum of the two currents flowing in a single wire occupying their mean position. The resultant radiation pattern and directivity generated by these currents is very close to that of a short dipole having a constant current over its length. The directivity relative to an isotropic radiator is approximately 1.8 dBi, as compared to the directivity of a half-wave dipole of 2.14 dBi.

Recall that FIG. 22 is a simplified view of the element of FIG. 6, with arrows, 228 and 229 depicting the direction of current flow in the various segments when operating at $f_1$. The currents in the close parallel segments, 222 and 225, are in phase at $f_1$. From this, the currents in the upper horizontal segments, 223 and 226, are in anti-phase as are those in the lower horizontal segments, 224 and 227. The current phases are such that the radiation field from the horizontal segments 223, 224, 226 and 227 cancel each other and the net resultant field is generated by the currents in segments 222 and 225, resulting in a vertical omni-directional E field.

Figure 31:
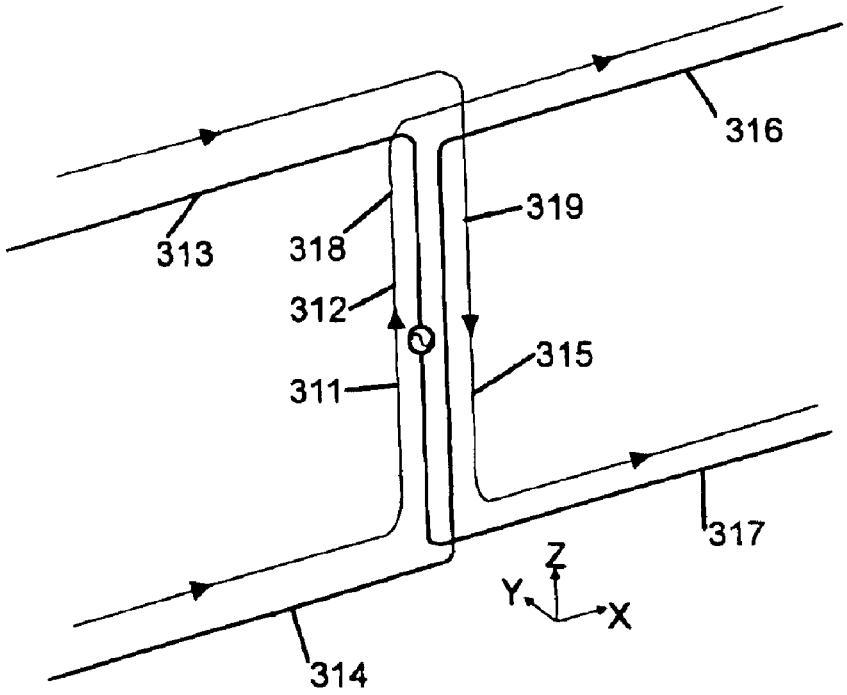
FIG. 31 is a simplified view of the element of FIG. 21 showing the direction of current flow when the element is operating at $f_2$.

Similarly, FIG. 31 shows the direction of current flow when the element is operating at $f_2$. The currents in the close parallel segments, 312 and 315, are now in anti-phase and the currents in the horizontal segments, 313, 316, 314, and 317 are in phase. The segments 313 and 316 behave as a center-fed short dipole, as do segments 314 and 317. These two short dipoles are spaced vertically by approximately $$\frac{\lambda}{6}$$

and thus the two short dipoles behave as a pair of stacked dipoles fed in phase.

Figure 32:
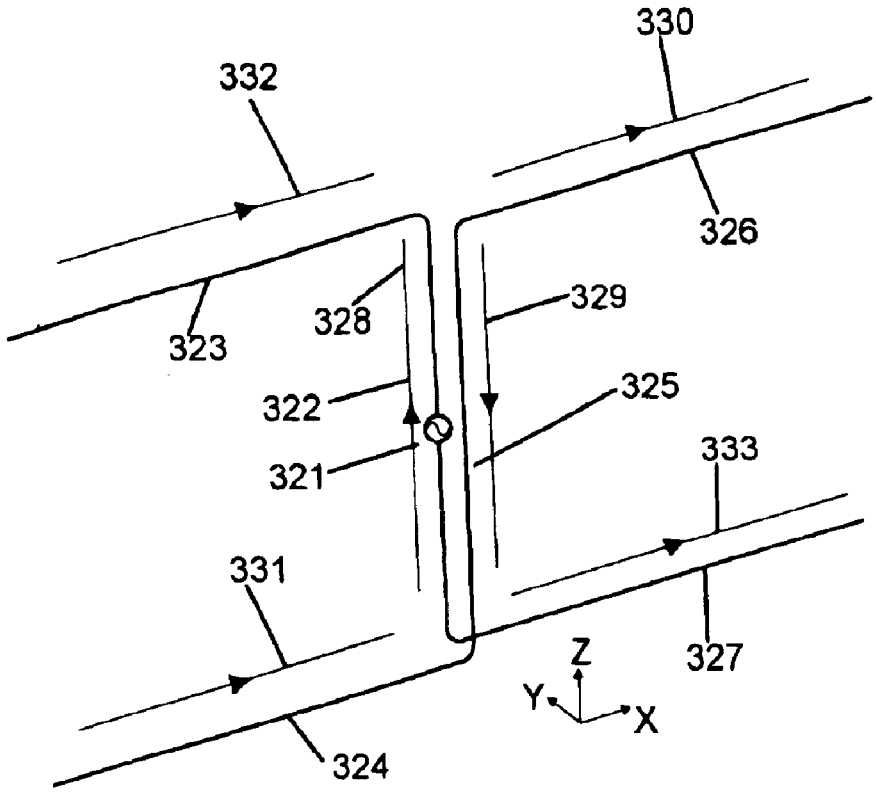
FIG. 32 is a simplified view of the element of FIG. 21 showing an alternative direction of current flow when the element is operating at the third harmonic frequency, $f_3$.

At $f_3$, or approximately the third harmonic of $f_1$, the currents in the segments are shown in FIG. 32. The total length of the segments in each sub-element is now $$\frac{3\lambda}{2}.$$

Since there is a current phase reversal in each $$\frac{\lambda}{2}$$

segment, the current phases change to those shown in FIG. 32. The horizontal segments 323, 324, 326 and 327 are now each $$\frac{\lambda}{2}$$

long. In FIG. 32, currents in the driven sub-element segments 322, 323 and 327 are indicated by arrows 328, 332 and 333 respectively, and in the parasitic sub-element segments 325, 326 and 324 by arrows 329, 330 and 331 respectively. From these it can be seen that the currents in the horizontal segments 323, 324, 326 and 327 in FIG. 32 are all in phase, whereas the currents in the vertical segments 322 and 325 are in anti-phase. The vertical E field radiation from segments 322 and 325 is therefore cancelled, and the resulting E field is generated by segments 323, 324, 326 and 327, and is horizontally polarized. In addition, since the segments 323, 324, 326 and 327 in FIG. 32 are spaced from each other both vertically and horizontally, the resulting E field has substantial directivity when compared to that of a half-wave dipole.

It can be seen from the foregoing that the element has three useful resonant frequencies, and can be used as the basic element in a directive array, similar to that shown in FIG. 25. As discussed previously, the source of radio frequency power drives the center of the sub-element 262 which, together with the parasitic sub-element 263 comprise the driven element of the antenna. Recall that the spacing of the elements at frequencies $f_1$ and $f_2$ is much closer than in a conventional yagi antenna. This means that the feed point impedance at $f_1$ and $f_2$ can be similar to the feed point impedance at $f_3$.

It has been found that it is possible to optimize the antenna shown in FIG. 25 for operation at either $f_1$ and $f_3$, or at $f_2$ and $f_3$. FIG. 25 has been discussed previously in the context of operation at $f_1$ and $f_3$, where the polarization at $f_1$ is at right angles to the polarization at $f_3$. For many applications it is desirable to have the same polarization at two frequencies where $f_3$ is close to three times $f_2$, and this may be achieved as follows. It has been shown that the coupling coefficient between the two sub-elements controls the frequency $f_2$ at which the radiation field is polarized in the same direction as at $f_3$. By reducing the coupling between the two sub-elements, $f_2$ can be adjusted to be approximately one third of $f_3$ or close thereto, and at the same time provide similar radiation resistance at both frequencies. Practically there are two methods to reduce the coupling between the sub-elements. Referring again to FIG. 6, in the first method the segments 102 and 108 are reduced in length to less than $$\frac{\lambda}{2}$$

at $f_3$ and the segments 103, 104, 106 and 107 are increased in length to greater than $$\frac{\lambda}{2}.$$

Figure 33:
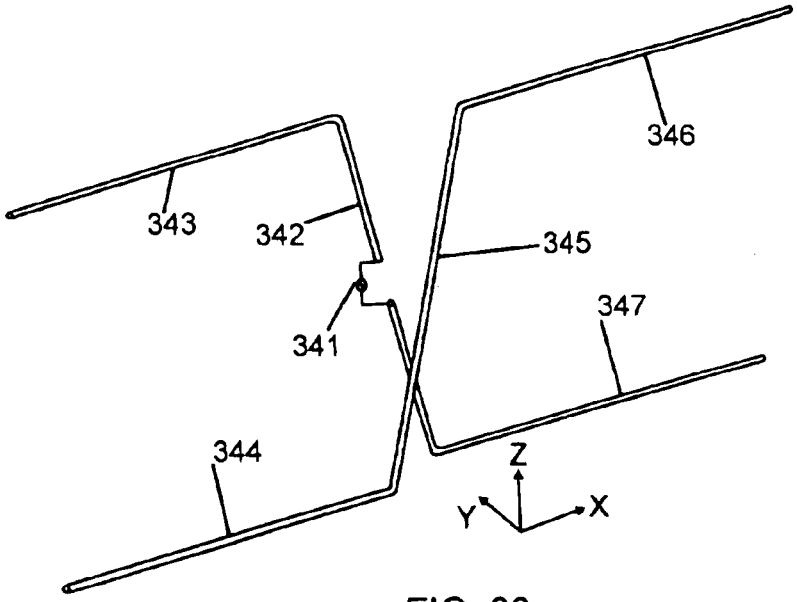
FIG. 33 shows the fourth embodiment of the present invention wherein the element is optimized only at $f_3$.
Figure 34:
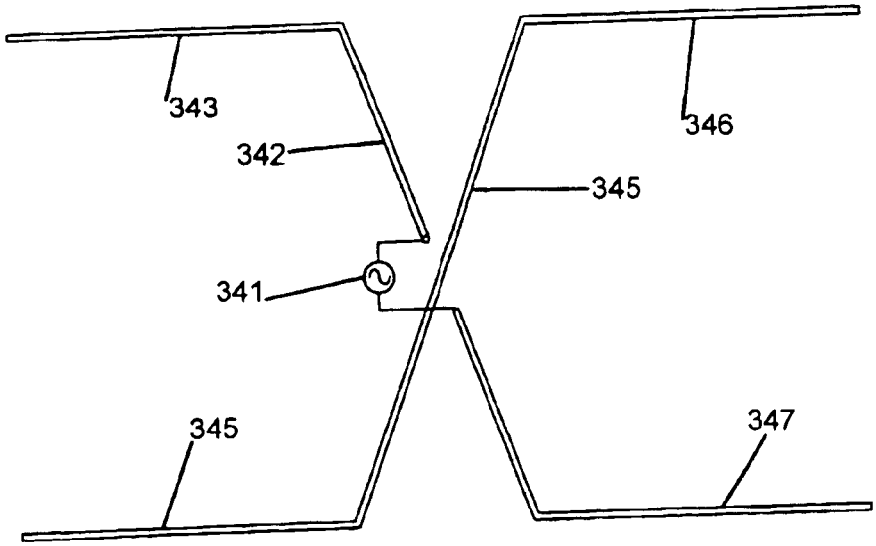
FIG. 34 shows a view of the element depicted in FIG. 33 along the y axis.
Figure 35:
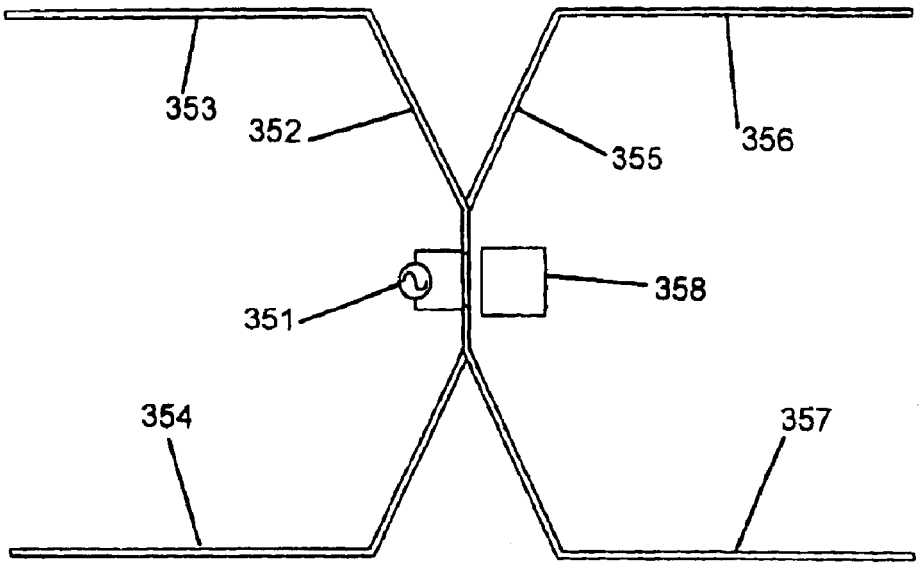
FIG. 35 shows a modified version of the element depicted in FIG. 33.

The reduction in length of segments 102 and 108 reduces the coupling coefficient between the two sub-elements such that $f_2$ is reduced, and the increase in length of segments 103, 104, 106 and 107 maintains $f_3$ at the desired frequency. This method also increases the effective stacking distance between the segments 103 and 106, and the segments 104 and 107 in the x direction, resulting in higher directivity, although this is offset by the reduction in stacking distance in the y dimension. In the second method, the closely parallel segments 102 and 108 are angled away from each other as shown by segments 342 and 345 in FIG. 33, which illustrates the fourth embodiment of the present invention. By suitably adjusting the angle between the segments 342 and 345 the coupling between the sub-elements may be reduced such that $f_2$ is reduced as in the first method. This second method also increases the stacking distance between segments 343 and 346 and segments 344 and 347 in the x direction, with a smaller reduction in the stacking distance in the y direction, and thus results in higher directivity than the first method. For clarification, FIG. 34 shows a view of the element depicted in FIG. 33 along the y axis. A slightly modified version of the element is shown in FIG. 35, where the centers of the sub-elements 352 and 355 are parallel for a short distance in order to facilitate mounting to a support boom, 358.

It should be noted that the ratio of $f_3$ to $f_2$ may be less than 3:1. Practical designs have shown that ratios of from a little over 2:1 to 3:1 are perfectly feasible.

Figure 36:
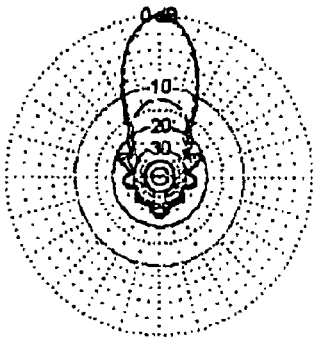
FIG. 36 shows the radiation pattern for an 8-element dual-band directive array antenna according to the fourth embodiment of the present invention at 144 MHz.
Figure 37:
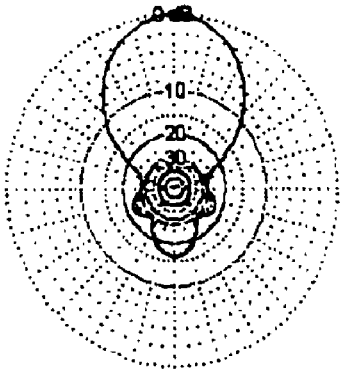
FIG. 37 shows the radiation pattern for an 8-element dual-band directive array antenna according to the fourth embodiment of the present invention at 50.3 MHz.
Figure 38:
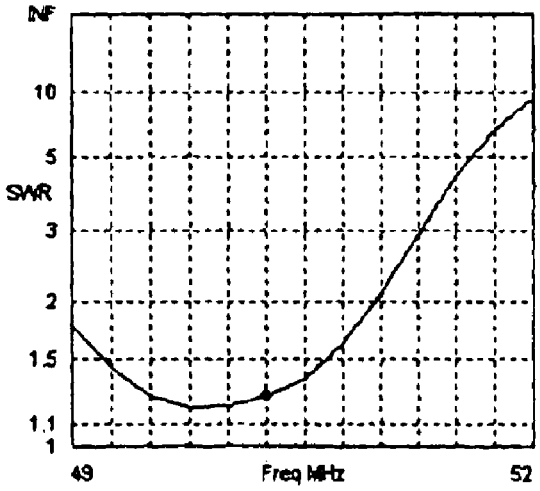
FIG. 38 shows the SWR plot versus frequency for an 8-element dual-band directive array antenna according to the fourth embodiment of the present invention in the 50 MHz band.
Figure 39:
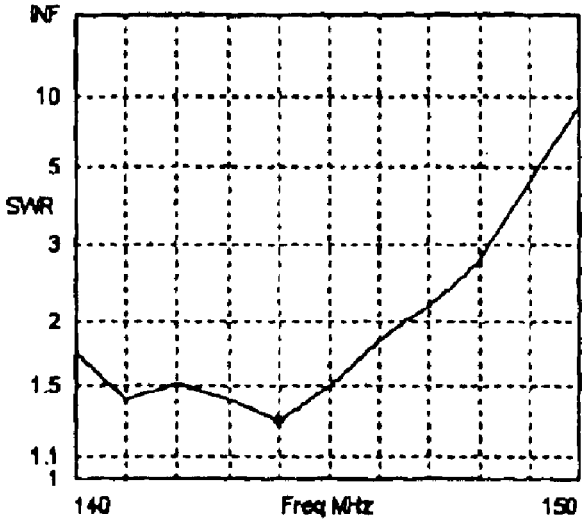
FIG. 39 shows the SWR plot versus frequency for an 8-element dual-band directive array antenna according to the fourth embodiment of the present invention in the 144 MHz band.

The following are two examples of the application of the above principles to dual-band directive arrays having the same polarization sense on both bands. The first is that of an 8 element antenna designed for the 50 MHz and 144 MHz bands. FIGS. 36 and 37 show the radiation pattern plots at 144 MHz and 50.3 MHz respectively, and FIGS. 38 and 39 show the SWR plots versus frequency in a 50 ohm system. The antenna has a total length of 3.3 meters, or 1.6λ at 144 MHz, and has a gain of 14.76 dBi. A conventional high performance long yagi would need to be 2.75λ, or 5.72 meters, long to provide the same gain.

Figure 40:
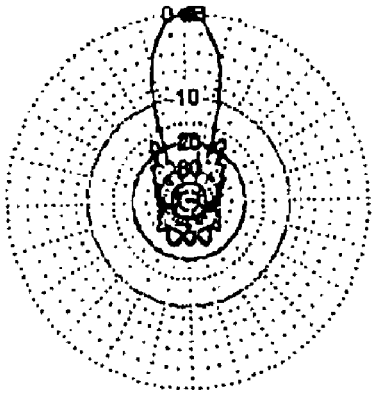
FIG. 40 shows the radiation pattern for a 20-element antenna according to the fourth embodiment of the present invention at 3456 MHz.
Figure 41:
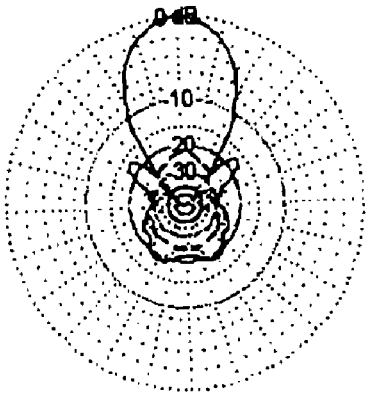
FIG. 41 shows the radiation pattern for a 20-element antenna according to the fourth embodiment of the present invention at 1296 MHz.
Figure 42:
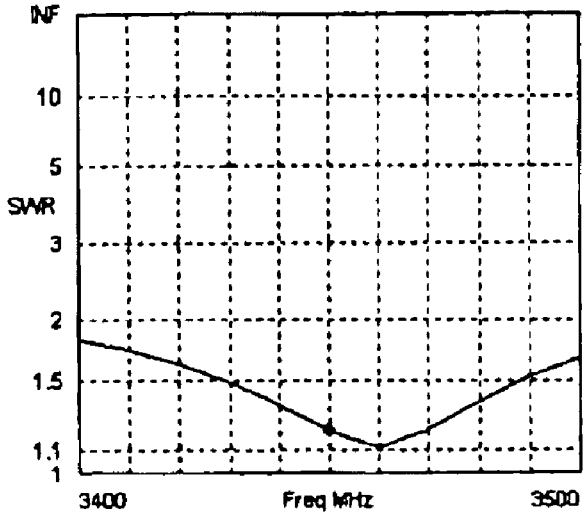
FIG. 42 shows the SWR plot versus frequency for a 20-element antenna according to the fourth embodiment of the present invention at 3456 MHz.
Figure 43:
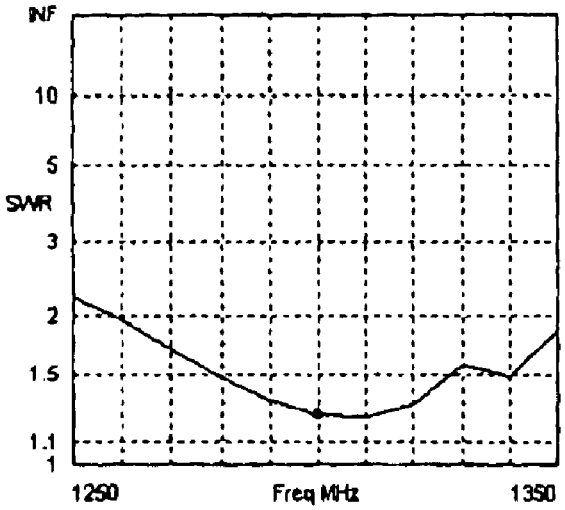
FIG. 43 shows the SWR plot versus frequency for a 20-element antenna according to the fourth embodiment of the present invention at 1296 MHz.

The above antenna uses the second method of reducing the coupling between the sub-elements. Another example of this embodiment is a 20-element antenna designed to operate on 3456 MHz and 1296 MHz. FIGS. 40 and 41 show the radiation patterns at 3456 MHz and 1296 MHz respectively, and FIGS. 42 and 43 show the SWR plots versus frequency in a 50 ohm system. This antenna is 5.2λ long at 3456 MHz and has a gain of 17.72 dBi., which is the same as would be achieved with a conventional long yagi having the same length. At 1296 MHz, the antenna is 1.95λ long and has a gain of 13.1 dB, which is 0.5 dB less than that of a conventional long-yagi having the same length.

From the above examples it can be seen that the antennas provide excellent performance both in terms of gain, pattern and SWR. As expected, the gain of the antenna of the first example above is higher at $f_3$ because the second method of reducing the coupling between the sub-elements, that of angling the close parallel segments, is used.

Figure 44:
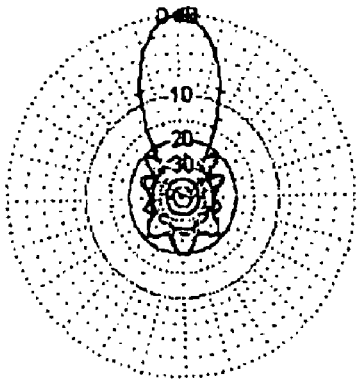
FIG. 44 shows the radiation pattern for an 8-element antenna according to the fourth embodiment of the present invention at 432 MHz.
Figure 45:
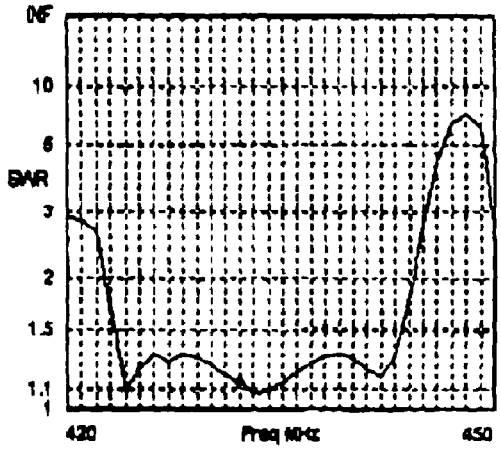
FIG. 45 the SWR plot versus frequency for an 8-element antenna according to the fourth embodiment of the present invention at 432 MHz.

In the fourth embodiment, the element shown in FIG. 33 is again used as the basic element, but in this case the multi-element antenna is optimized only at $f_3$. It should be realized that the dual band antennas described above require compromises in order to provide satisfactory performance at both frequencies. In general the gain at $f_3$ is lower than the maximum achievable because of the necessity to provide good performance at $f_2$. Without this constraint, significantly higher gain at $f_3$ is achievable. For example, an 8-element antenna designed for a center frequency of 432 MHz according to the fourth embodiment that is 1.5λ long has a gain of 15.5 dBi, whereas a conventional long yagi would need to be 3.3λ long in order to achieve the same gain. FIG. 44 shows the radiation pattern and FIG. 45 the SWR plot for this antenna. Note that this antenna has been optimized for a feed point impedance of 80 ohms. The excellent characteristics of the antenna can be seen from these plots.

The data on antenna performance contained herein is based on both the measured performance of prototype antennas and on computer simulations. Measurements on the prototypes have shown that the computer models accurately predict the performance of physical antennas.

It will thus be seen that the objects set forth above, among those made apparent from the preceding description, are efficiently attained and, because certain changes may be made in carrying out the above method and in the construction(s) set forth without departing from the spirit and scope of the invention, it is intended that all matter contained in the above description and shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed:

1. An antenna element for use at an operating frequency and corresponding wavelength, comprising:

a first sub-element having a total length of approximately one-half wavelength in a substantially rectangular shape; the first sub-element comprising first and third sides each having a length of approximately one-sixth wavelength, and second and fourth sides each having a width of approximately one-twelfth wavelength; wherein a signal is connected in series to a feed-point located at the mid-point of the first side; wherein a first gap is located at the mid-point of the third side and is a first fraction of the wavelength in length; and a second sub-element having a total length of approximately one-half wavelength in a substantially rectangular shape; the second sub-element comprising fifth and seventh sides each having a length of approximately one-sixth wavelength, and sixth and eighth sides each having a width of approximately one-twelfth wavelength; wherein a second gap of said first fraction in length is located at the mid-point of the seventh side;

said first side of said first sub-element being positioned in parallel and spaced a second fraction of the wavelength apart from the fifth side of said second sub-element, such that the first and second sub-elements are magnetically coupled.

2. The antenna element according to claim 1, wherein the first and second sub-elements are conductors of wire, rod, tubing or printed circuit trace.

3. The antenna element according to claim 1, wherein the combination of the first and second sub-elements results in a higher feed-point impedance, a lower conductor resistance loss, and a broader bandwidth than a single sub-element.

4. The antenna element according to claim 1, having a feed-point impedance suitable for connection directly to a 50 ohm transmission line.

5. The antenna element according to claim 1, wherein the first and second sub-elements are positioned in the same plane.

6. The antenna element according to claim 1, wherein the first and second sub-elements are positioned in different planes at an angle to each other.

7. The antenna element according to claim 1, comprising a plurality of second sub-elements positioned in parallel and in different planes at an angle to the plane containing said first side of said first sub-element; the antenna element having an adjustable feed-point impedance based on the number of second sub-elements and an aspect ratio of the sub-elements relative to the first sub-element.

8. A multi-band antenna comprising a plurality of antenna elements according to claim 1 positioned parallel to each other, wherein each antenna element is dimensioned to operate at a different operating frequency, and the feed-point for each antenna element is connected to a common signal.

9. An antenna element for use at an operating frequency and corresponding wavelength, comprising:

a first sub-element having a total length of approximately one-half wavelength in a substantially step-like shape; the first sub-element comprising sequentially first, second, and third sections each having a length of approximately one-sixth wavelength; wherein a signal is connected in series to a feed-point located at the mid-point of the second section; and a second sub-element having a total length of approximately one-half wavelength in a substantially step-like shape; the second sub-element comprising sequentially fourth, fifth, and sixth sections each having a length of approximately one-sixth wavelength;

said first and second sub-elements being transposed relative to each other such that the first section of said first sub-element is positioned in line with the sixth section of said second sub-element and the third section of said first sub-element is positioned in line with the fourth section of said second sub-element; said second section of said first sub-element being spaced a fraction of the wavelength apart from the fifth section of said second sub-element, such that the first and second sub-elements are magnetically coupled.

10. The antenna element according to claim 9, wherein the first and second sub-elements are conductors of wire, rod, tubing or printed circuit trace.

11. The antenna element according to claim 9, wherein the antenna element produces an electric field polarization that is vertical when operating at a first frequency, horizontal when operating at a second frequency, and horizontal when operating at a third frequency.

12. The antenna element according to claim 9, wherein said second section of said first sub-element and the fifth section of said second sub-element are vertical and parallel.

13. The antenna element according to claim 9, wherein the first and second sub-elements lie in parallel planes and the second section of said first sub-element is positioned at an angle to the fifth section of said second sub-element, thereby reducing the magnetic coupling.

14. The antenna element according to claim 9, wherein the second section of said first sub-element and the fifth section of said second sub-element are curved apart such that the mid-points of the second section and fifth section are spaced further apart than the ends of the second and fifth sections.

15. A directive antenna comprising a plurality of antenna elements according to claim 9, wherein one of said plurality of antenna elements is a driven element; the remainder of said plurality of antenna elements are parasitic elements; at least one parasitic element is positioned in parallel on a first side of said driven element to act as a reflector element; the remainder of said parasitic elements are positioned in parallel on a second side of said driven element to act as director elements; whereby the elements provide directivity based on the frequency.

16. A ground plane antenna element for use at an operating frequency and corresponding wavelength, comprising:

a first sub-element having a total length of approximately one-quarter wavelength comprising sequentially first, second, and third sections; the first section extending vertically upwards from a ground plane, the second section extending horizontally, parallel to the ground plane, and the third section extending vertically down towards the ground plane; the end of the third section forming a gap with the ground plane a first fraction of the wavelength in length; wherein a signal is connected to a feed-point between the first section and the ground plane; and a plurality of second sub-elements, each having a total length of approximately one-quarter wavelength comprising sequentially first, second, and third sections; the first section connecting to and extending vertically upwards from the ground plane, the second section extending horizontally, parallel to the ground plane, and the third section extending vertically down towards the ground plane; the end of the third section forming a gap with the ground plane the first fraction of the wavelength in length;

said plurality of second sub-elements being disposed symmetrically and in parallel around said first sub-element and being spaced a second fraction of the wavelength apart from each neighboring sub-element.

17. The ground plane antenna according to claim 16, wherein the first and second sub-elements are conductors of wire, rod, tubing or printed circuit trace.

18. The ground plane antenna according to claim 16, wherein the combination of the first and second sub-elements results in a reduced physical height without discrete loading elements and a higher feed-point impedance than a single sub-element.

* * * * *